US010947025B2

(12) United States Patent
Sollie et al.

(10) Patent No.: US 10,947,025 B2
(45) Date of Patent: Mar. 16, 2021

(54) INSULATED BLOCK PACKAGING ASSEMBLY

(71) Applicant: Pratt Corrugated Holdings, Inc., Conyers, GA (US)

(72) Inventors: Greg Sollie, Sharpsburg, GA (US); Jamie Waitermire, Peachtree City, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 0 days.

(21) Appl. No.: 15/845,540

(22) Filed: Dec. 18, 2017

(65) Prior Publication Data

US 2019/0185246 A1 Jun. 20, 2019

(51) Int. Cl.

| | |
|---|---|
| ***B65D 81/38*** | (2006.01) |
| ***B65D 5/32*** | (2006.01) |
| ***B65D 5/68*** | (2006.01) |
| ***B65D 81/107*** | (2006.01) |

(52) U.S. Cl.

CPC ..... *B65D 81/3816* (2013.01); *B65D 5/328* (2013.01); *B65D 5/68* (2013.01); *B65D 81/107* (2013.01); *B65D 81/3858* (2013.01)

(58) Field of Classification Search

CPC .... B65D 81/3816; B65D 5/328; B65D 81/08; B65D 81/3858; B65D 5/68; B65D 81/107

USPC ..... 220/592.25

See application file for complete search history.

(56) References Cited

U.S. PATENT DOCUMENTS

| | | | |
|---|---|---|---|
| 265,985 | A | 10/1882 | Seabury |
| 1,527,167 | A | 2/1925 | Birdseye |
| 1,677,565 | A | 7/1928 | Oppenheim |
| 1,682,410 | A | 8/1928 | Oppenheim |
| 1,747,980 | A | 2/1930 | Kondolf |
| 1,753,813 | A | 4/1930 | Washburn |
| 1,868,996 | A | 7/1932 | Sharp |
| 1,896,393 | A | 2/1933 | Devine |
| 1,899,892 | A | 2/1933 | D'Este et al. |
| 1,930,680 | A | 10/1933 | Hinton |
| 1,935,923 | A | 11/1933 | Thoke |
| 1,937,263 | A | 11/1933 | Bubb |
| 1,942,917 | A | 1/1934 | D'Este et al. |
| 1,954,013 | A | 4/1934 | Lilienfield |
| 2,018,519 | A | 10/1935 | Hall |
| 2,070,747 | A | 2/1937 | Ostrom |

(Continued)

FOREIGN PATENT DOCUMENTS

| | | |
|---|---|---|
| CA | 2019104 | 12/1991 |
| CN | 206494316 | 9/2017 |

(Continued)

OTHER PUBLICATIONS

US 10,562,676 B2, 02/2020, Waltermire et al. (withdrawn)

(Continued)

*Primary Examiner* — J. Gregory Pickett

*Assistant Examiner* — Niki M Eloshway

(74) *Attorney, Agent, or Firm* — Taylor English Duma LLP

(57) ABSTRACT

A packaging assembly includes first insulation blocks, second insulation blocks, and third insulation blocks, each insulation block arranged in contact with at least one other insulation block to define a void, the packaging assembly including at least one enclosure, the insulation blocks at least partially surrounded by the at least one enclosure.

8 Claims, 5 Drawing Sheets

(56) References Cited

U.S. PATENT DOCUMENTS 2,116,513 A 5/1938 Frankenstein
2,148,454 A 2/1939 Gerard
2,165,327 A 7/1939 Zalkind
2,289,060 A 7/1942 Merkle
2,293,361 A 8/1942 Roberts
2,360,806 A 10/1944 Van Rosen
2,386,905 A 10/1945 Meitzen
2,389,601 A 11/1945 De Witt
2,485,643 A 10/1949 Norquist
2,554,004 A 5/1951 Bergstein
2,632,311 A 3/1953 Sullivan
2,650,016 A 8/1953 McMillan
2,753,102 A 7/1956 Paige
2,867,035 A 1/1959 Patterson, Jr.
2,899,103 A 8/1959 Ebert
2,927,720 A 3/1960 Adams
2,987,239 A 6/1961 Atwood
3,029,008 A 4/1962 Membrino
3,031,121 A 4/1962 Chase
3,065,895 A 11/1962 Lipschutz
3,096,879 A 7/1963 Schumacher
3,097,782 A 7/1963 Koropatkin et al.
3,182,913 A 5/1965 Brian
3,193,176 A 7/1965 Gullickson et al.
3,222,843 A 12/1965 Schneider
3,236,206 A * 2/1966 Willinger ..... A01K 63/02 119/203
3,282,411 A 11/1966 Jardine
3,286,825 A 11/1966 Laas
3,335,941 A 8/1967 Gatward
3,371,462 A 3/1968 Nordkvist et al.
3,375,934 A 4/1968 Bates
3,420,363 A * 1/1969 Blickensderfer .. B65D 81/1275 206/524
3,435,736 A 4/1969 Reiche
3,503,550 A 3/1970 Main et al.
3,551,945 A 1/1971 Eyberg et al.
3,670,948 A 6/1972 Berg
3,703,383 A 11/1972 Kuchenbecker
3,734,336 A 5/1973 Rankow et al.
3,747,743 A 7/1973 Hoffman, Jr.
3,749,299 A 7/1973 Ingle
3,836,044 A 9/1974 Tilp et al.
3,843,038 A 10/1974 Sax
3,880,341 A 4/1975 Bamburg et al.
3,887,743 A 6/1975 Lane
3,890,762 A 6/1975 Ernst et al.
3,980,005 A 9/1976 Buonaiuto
4,030,227 A 6/1977 Oftedahl
4,050,264 A 9/1977 Tanaka
4,068,779 A 1/1978 Canfield
4,091,852 A 5/1978 Jordan et al.
4,169,540 A 10/1979 Larsson et al.
4,211,267 A 7/1980 Skovgaard
4,213,310 A 7/1980 Buss
4,335,844 A 6/1982 Egli
4,342,416 A 8/1982 Philips
4,380,314 A 4/1983 Langston, Jr. et al.
4,396,144 A 8/1983 Gutierrez et al.
4,418,864 A 12/1983 Neilsen
4,488,623 A 12/1984 Linnell, II et al.
4,509,645 A 4/1985 Hotta
4,679,242 A 7/1987 Brockhaus
4,682,708 A 7/1987 Pool
4,797,010 A 1/1989 Coelho
4,819,793 A 4/1989 Willard et al.
4,828,133 A 5/1989 Hougendobler
4,830,282 A 5/1989 Knight, Jr.
4,889,252 A 12/1989 Rockom et al.
4,930,903 A 6/1990 Mahoney
4,989,780 A 2/1991 Foote et al.
5,016,813 A 5/1991 Simons
5,020,481 A * 6/1991 Nelson ..... F24H 1/182 122/19.2
5,062,527 A 11/1991 Westerman
5,094,547 A 3/1992 Graham
5,102,004 A * 4/1992 Hollander ..... B29C 44/569 220/592.25
5,154,309 A 10/1992 Wischusen, III et al.
5,158,371 A 10/1992 Moravek
5,165,583 A 11/1992 Kouwenberg
5,185,904 A 2/1993 Rogers et al.
5,230,450 A 7/1993 Mahvi et al.
5,263,339 A 11/1993 Evans
5,358,757 A 10/1994 Robinette et al.
5,372,429 A 12/1994 Beaver, Jr. et al.
5,417,342 A 5/1995 Hutchison
5,418,031 A 5/1995 English
5,441,170 A 8/1995 Bane, III
5,454,471 A 10/1995 Norvell
5,491,186 A 2/1996 Kean et al.
5,493,874 A 2/1996 Landgrebe
5,499,473 A 3/1996 Ramberg
5,505,810 A 4/1996 Kirby et al.
5,511,667 A 4/1996 Carder
5,512,345 A 4/1996 Tsutsumi et al.
5,516,580 A 5/1996 Frenette et al.
5,562,228 A 10/1996 Ericson
5,573,119 A 11/1996 Luray
5,596,880 A 1/1997 Welker et al.
5,613,610 A 3/1997 Bradford
5,615,795 A 4/1997 Tipps
5,638,978 A 6/1997 Cadiente
5,775,576 A 7/1998 Stone
5,842,571 A 12/1998 Rausch
5,906,290 A 5/1999 Haberkorn
5,996,366 A 12/1999 Renard
6,003,719 A 12/1999 Steward, III
6,041,958 A * 3/2000 Tremelo ..... B65D 19/06 206/600
6,048,099 A 4/2000 Muffett et al.
6,050,412 A 4/2000 Clough et al.
6,138,902 A 10/2000 Welch
6,164,526 A 12/2000 Dalvey
6,168,040 B1 1/2001 Sautner et al.
6,220,473 B1 4/2001 Lehman et al.
6,223,551 B1 5/2001 Mitchell
6,238,091 B1 5/2001 Mogil
6,244,458 B1 6/2001 Frysinger et al.
6,247,328 B1 6/2001 Mogil
6,295,830 B1 10/2001 Newman
6,295,860 B1 10/2001 Sakairi et al.
6,308,850 B1 10/2001 Coom et al.
6,325,281 B1 12/2001 Grogan
6,443,309 B1 9/2002 Becker
6,453,682 B1 9/2002 Jennings et al.
6,478,268 B1 11/2002 Bidwell et al.
6,510,705 B1 1/2003 Jackson
6,582,124 B2 6/2003 Mogil
6,618,868 B2 9/2003 Minnick
6,688,133 B1 2/2004 Donefrio
6,725,783 B2 4/2004 Sekino
6,726,017 B2 4/2004 Maresh et al.
6,736,309 B1 5/2004 Westerman et al.
6,771,183 B2 8/2004 Hunter
6,821,019 B2 11/2004 Mogil
6,837,420 B2 1/2005 Westerman et al.
6,868,982 B2 3/2005 Gordon
6,875,486 B2 4/2005 Miller
6,899,229 B2 5/2005 Dennison et al.
6,910,582 B2 6/2005 Lantz
6,913,389 B2 7/2005 Kannankeril et al.
6,971,539 B1 12/2005 Abbe
7,000,962 B2 2/2006 Le
7,019,271 B2 3/2006 Wnek et al.
7,094,192 B2 8/2006 Schoenberger et al.
7,140,773 B2 11/2006 Becker et al.
7,225,632 B2 6/2007 Derifield
7,225,970 B2 6/2007 Philips
7,229,677 B2 6/2007 Miller
7,264,147 B1 9/2007 Benson et al.
7,392,931 B2 7/2008 Issler
7,452,316 B2 11/2008 Cals et al.
D582,676 S 12/2008 Rothschild

(56) References Cited

U.S. PATENT DOCUMENTS 7,597,209 B2 10/2009 Rothschild et al.
7,607,563 B2 10/2009 Hanna et al.
7,677,406 B2 3/2010 Maxson
7,681,405 B2 3/2010 Williams
7,784,301 B2 8/2010 Sasaki et al.
7,807,773 B2 10/2010 Matsuoka et al.
7,841,512 B2 11/2010 Westerman
7,845,508 B2 12/2010 Rothschild et al.
7,870,992 B2 1/2011 Schille et al.
7,909,806 B2 3/2011 Goodman et al.
7,971,720 B2 7/2011 Minkler
8,118,177 B2 2/2012 Drapela et al.
8,209,995 B2 7/2012 Kieling et al.
8,343,024 B1 1/2013 Contanzo, Jr. et al.
8,365,943 B2 2/2013 Bentley
8,465,404 B2 6/2013 Hadley
8,579,183 B2 11/2013 Belfort et al.
8,596,520 B2 12/2013 Scott
8,613,202 B2 12/2013 Williams
8,651,593 B2 2/2014 Bezich et al.
8,763,811 B2 7/2014 Lantz
8,763,886 B2 * 7/2014 Hall ..... B65D 81/3818 220/592.25
8,795,470 B2 8/2014 Henderson et al.
8,919,082 B1 * 12/2014 Cataldo ..... B65D 81/3816 220/4.29
8,960,528 B2 2/2015 Sadlier
9,272,475 B2 3/2016 Ranade et al.
9,290,313 B2 3/2016 De Lesseux et al.
9,322,136 B2 4/2016 Ostendorf et al.
D758,182 S 6/2016 Sponselee
9,408,445 B2 8/2016 Mogil et al.
9,429,350 B2 8/2016 Chapman, Jr.
9,499,294 B1 11/2016 Contanzo, Jr.
9,550,618 B1 1/2017 Jobe
9,605,382 B2 3/2017 Virtanen
9,611,067 B2 4/2017 Collison
9,635,916 B2 5/2017 Bezich et al.
9,701,437 B2 7/2017 Bugas et al.
9,738,420 B2 8/2017 Miller
9,738,432 B1 8/2017 Petrucci et al.
9,834,366 B2 12/2017 Giuliani
9,908,680 B2 3/2018 Shi et al.
9,908,684 B2 3/2018 Collison
9,920,517 B2 3/2018 Sollie
9,950,830 B2 4/2018 De Lesseux et al.
9,981,797 B2 5/2018 Aksan et al.
10,046,901 B1 8/2018 Jobe
10,094,126 B2 10/2018 Collison et al.
10,112,756 B2 10/2018 Menzel, Jr.
10,226,909 B2 3/2019 Frem et al.
10,266,332 B2 4/2019 Aksan et al.
10,357,936 B1 7/2019 Vincent et al.
10,442,600 B2 10/2019 Waltermire et al.
10,507,968 B2 12/2019 Sollie et al.
10,551,110 B2 2/2020 Waltermire et al.
10,583,977 B2 3/2020 Collison et al.
10,800,595 B2 10/2020 Waltermire et al.
10,843,840 B2 11/2020 Sollie et al.
10,858,141 B2 12/2020 Sollie et al.
10,882,681 B2 1/2021 Waltermire et al.
10,882,682 B2 1/2021 Collison et al.
10,882,683 B2 1/2021 Collison et al.
10,882,684 B2 1/2021 Sollie et al.
2001/0010312 A1 8/2001 Mogil
2002/0020188 A1 2/2002 Sharon et al.
2002/0064318 A1 5/2002 Malone et al.
2002/0162767 A1 11/2002 Ohtsubo
2003/0145561 A1 8/2003 Cals et al.
2004/0004111 A1 1/2004 Cardinale
2004/0031842 A1 2/2004 Westerman et al.
2004/0079794 A1 * 4/2004 Mayer ..... B65D 81/3816 229/103.11
2005/0109655 A1 5/2005 Vershum et al.
2005/0117817 A1 6/2005 Mogil et al.
2005/0189404 A1 * 9/2005 Xiaohai ..... B65D 81/3862 229/103.11
2005/0214512 A1 9/2005 Fascio
2005/0224501 A1 10/2005 Folkert et al.
2005/0279963 A1 * 12/2005 Church ..... E04B 1/7604 252/62
2006/0053828 A1 3/2006 Shallman et al.
2006/0078720 A1 * 4/2006 Toas ..... C03C 25/146 428/292.1
2006/0096978 A1 5/2006 Lafferty et al.
2006/0193541 A1 8/2006 Norcom
2007/0000932 A1 1/2007 Cron et al.
2007/0000983 A1 1/2007 Spurrell et al.
2007/0051782 A1 3/2007 Lantz
2007/0193298 A1 8/2007 Derifield
2007/0209307 A1 * 9/2007 Andersen ..... D04H 1/72 52/404.1
2007/0257040 A1 11/2007 Price, Jr. et al.
2008/0095959 A1 4/2008 Warner et al.
2008/0135564 A1 6/2008 Romero
2008/0173703 A1 7/2008 Westerman et al.
2008/0190940 A1 8/2008 Scott
2008/0203090 A1 8/2008 Dickinson
2008/0289302 A1 11/2008 Vulpitta
2008/0296356 A1 12/2008 Hatcher et al.
2008/0308616 A1 12/2008 Phung
2008/0314794 A1 12/2008 Bowman
2009/0034883 A1 2/2009 Giuliani
2009/0114311 A1 5/2009 McDowell
2009/0193765 A1 8/2009 Lantz
2009/0214142 A1 8/2009 Bossel et al.
2009/0283578 A1 11/2009 Miller
2009/0288791 A1 11/2009 Hammer et al.
2010/0001056 A1 1/2010 Chandaria
2010/0006630 A1 1/2010 Humphries et al.
2010/0062921 A1 3/2010 Veiseh
2010/0072105 A1 3/2010 Glaser et al.
2010/0139878 A1 6/2010 Clemente
2010/0151164 A1 6/2010 Grant et al.
2010/0258574 A1 10/2010 Bentley
2010/0270317 A1 10/2010 Kieling et al.
2010/0282827 A1 11/2010 Padovani
2010/0284634 A1 11/2010 Hadley
2010/0314397 A1 12/2010 Williams et al.
2010/0314437 A1 12/2010 Dowd
2011/0042449 A1 2/2011 Copenhaver et al.
2011/0100868 A1 5/2011 Lantz
2011/0114513 A1 5/2011 Miller
2011/0235950 A1 9/2011 Lin
2011/0284556 A1 * 11/2011 Palmer ..... B65D 81/3862 220/592.25
2011/0311758 A1 12/2011 Burns et al.
2011/0317944 A1 12/2011 Liu
2012/0031957 A1 2/2012 Whitaker
2012/0074823 A1 3/2012 Bezich et al.
2012/0145568 A1 6/2012 Collison et al.
2012/0243808 A1 9/2012 De Lesseux et al.
2012/0248101 A1 10/2012 Tumber et al.
2012/0251818 A1 10/2012 Axrup et al.
2012/0279896 A1 11/2012 Lantz
2013/0112694 A1 5/2013 Bentley
2013/0112695 A1 * 5/2013 Hall ..... B65D 5/0227 220/592.25
2013/0140317 A1 6/2013 Roskoss
2014/0000306 A1 1/2014 Chapman, Jr.
2014/0021208 A1 * 1/2014 Anti ..... A01N 1/0273 220/592.25
2014/0093697 A1 4/2014 Perry et al.
2014/0248003 A1 9/2014 Mogil et al.
2014/0319018 A1 10/2014 Collison
2014/0367393 A1 * 12/2014 Ranade ..... B65D 81/3825 220/592.25
2015/0110423 A1 4/2015 Fox et al.
2015/0166244 A1 * 6/2015 Wood ..... B65D 81/18 220/592.25
2015/0175338 A1 6/2015 Culp et al.
2015/0238033 A1 8/2015 Zavitsanos
2015/0239639 A1 8/2015 Wenner et al.

(56) References Cited

U.S. PATENT DOCUMENTS

| | | | | |
|---|---|---|---|---|
| 2015/0259126 | A1 | 9/2015 | McGoff et al. | |
| 2015/0284131 | A1 | 10/2015 | Genender et al. | |
| 2015/0345853 | A1 | 12/2015 | Oeyen | |
| 2016/0015039 | A1 | 1/2016 | Pierce | |
| 2016/0052696 | A1* | 2/2016 | Cook | E04B 1/7658 52/406.2 |
| 2016/0060017 | A1 | 3/2016 | De Lesseux et al. | |
| 2016/0304267 | A1 | 10/2016 | Aksan | |
| 2016/0325915 | A1 | 11/2016 | Aksan | |
| 2017/0015080 | A1 | 1/2017 | Collison et al. | |
| 2017/0043937 | A1 | 2/2017 | Lantz | |
| 2017/0198959 | A1 | 7/2017 | Morris | |
| 2017/0225870 | A1 | 8/2017 | Collison | |
| 2017/0233134 | A9 | 8/2017 | Grajales et al. | |
| 2017/0283157 | A1 | 10/2017 | Jobe | |
| 2017/0305639 | A1 | 10/2017 | Kuhn et al. | |
| 2017/0320653 | A1 | 11/2017 | Mogil et al. | |
| 2017/0334622 | A1 | 11/2017 | Menzel, Jr. | |
| 2017/0341847 | A1 | 11/2017 | Chase et al. | |
| 2017/0361973 | A1 | 12/2017 | Padilla | |
| 2017/0369226 | A1 | 12/2017 | Chase et al. | |
| 2018/0050857 | A1 | 2/2018 | Collison | |
| 2018/0051460 | A1 | 2/2018 | Sollie et al. | |
| 2018/0148246 | A1 | 5/2018 | Fu et al. | |
| 2018/0194534 | A1 | 7/2018 | Jobe | |
| 2018/0215525 | A1 | 8/2018 | Vogel et al. | |
| 2018/0229917 | A1 | 8/2018 | Jobe | |
| 2018/0237207 | A1 | 8/2018 | Aksan et al. | |
| 2018/0274837 | A1 | 9/2018 | Christensen | |
| 2018/0290813 | A1 | 10/2018 | Waltermire et al. | |
| 2018/0290815 | A1 | 10/2018 | Waltermire et al. | |
| 2018/0299059 | A1 | 10/2018 | McGoff et al. | |
| 2018/0327171 | A1 | 11/2018 | Waltermire et al. | |
| 2018/0327172 | A1 | 11/2018 | Waltermire et al. | |
| 2018/0334308 | A1 | 11/2018 | Moore et al. | |
| 2018/0335241 | A1 | 11/2018 | Li et al. | |
| 2019/0032991 | A1 | 1/2019 | Waltermire et al. | |
| 2019/0047775 | A1 | 2/2019 | Waltermire et al. | |
| 2019/0185247 | A1 | 6/2019 | Sollie et al. | |
| 2019/0193916 | A1 | 6/2019 | Waltermire et al. | |
| 2019/0210790 | A1 | 7/2019 | Rizzo et al. | |
| 2019/0234679 | A1 | 8/2019 | Waltermire et al. | |
| 2019/0248573 | A1 | 8/2019 | Collison et al. | |
| 2019/0270572 | A1 | 9/2019 | Collison et al. | |
| 2019/0270573 | A1 | 9/2019 | Collison et al. | |
| 2019/0352075 | A1 | 11/2019 | Waltermire et al. | |
| 2019/0352076 | A1 | 11/2019 | Waltermire et al. | |
| 2019/0352080 | A1 | 11/2019 | Waltermire et al. | |
| 2019/0359412 | A1 | 11/2019 | Sollie et al. | |
| 2019/0359413 | A1 | 11/2019 | Sollie et al. | |
| 2019/0359414 | A1 | 11/2019 | Sollie et al. | |
| 2019/0367209 | A1 | 12/2019 | Jobe | |
| 2019/0376636 | A1* | 12/2019 | Fellinger | F16L 59/147 |
| 2019/0382186 | A1 | 12/2019 | Sollie et al. | |
| 2019/0390892 | A1 | 12/2019 | Waltermire et al. | |
| 2020/0088458 | A1 | 3/2020 | Waltermire et al. | |
| 2020/0103159 | A1 | 4/2020 | Waltermire et al. | |
| 2020/0122896 | A1 | 4/2020 | Waltermire et al. | |
| 2020/0148409 | A1 | 5/2020 | Sollie et al. | |
| 2020/0148410 | A1 | 5/2020 | Sollie et al. | |
| 2020/0148453 | A1 | 5/2020 | Sollie et al. | |
| 2020/0283188 | A1 | 9/2020 | Sollie et al. | |
| 2020/0346816 | A1 | 11/2020 | Sollie et al. | |
| 2020/0346841 | A1 | 11/2020 | Sollie et al. | |

FOREIGN PATENT DOCUMENTS

| | | |
|---|---|---|
| CN | 108001787 | 5/2018 |
| DE | 1897846 | 7/1964 |
| DE | 102011016500 | 10/2012 |
| DE | 202017103230 | 7/2017 |
| DE | 202017003908 | 10/2017 |
| EP | 0133539 | 2/1985 |
| EP | 0537058 | 4/1993 |
| EP | 2990196 | 3/2016 |
| FR | 1241878 | 9/1960 |
| FR | 2705317 | 11/1994 |
| FR | 2820718 | 8/2002 |
| FR | 2821786 | 9/2002 |
| FR | 3016352 | 7/2015 |
| GB | 217683 | 6/1924 |
| GB | 235673 | 6/1925 |
| GB | 528289 | 1/1940 |
| GB | 713640 | 8/1954 |
| GB | 1204058 | 9/1970 |
| GB | 1305212 | 1/1973 |
| GB | 1372054 | 10/1974 |
| GB | 2400096 | 5/2006 |
| GB | 2516490 | 1/2015 |
| JP | 01254557 | 10/1989 |
| JP | 2005139582 | 6/2005 |
| JP | 2005247329 | 9/2005 |
| JP | 2012126440 | 7/2012 |
| WO | 8807476 | 10/1988 |
| WO | 9726192 | 7/1997 |
| WO | 9932374 | 7/1999 |
| WO | 2001070592 | 9/2001 |
| WO | 2014147425 | 9/2014 |
| WO | 2016187435 A2 | 5/2016 |
| WO | 2016187435 A3 | 11/2016 |
| WO | 2018089365 | 5/2018 |
| WO | 2018093586 | 5/2018 |
| WO | 2018227047 | 12/2018 |
| WO | 2019125904 | 6/2019 |
| WO | 2019125906 | 6/2019 |
| WO | 2019226199 | 11/2019 |
| WO | 2020101939 | 5/2020 |
| WO | 2020102023 | 5/2020 |
| WO | 2020122921 | 6/2020 |
| WO | 2020222943 | 11/2020 |

OTHER PUBLICATIONS

Salazar Packaging; Article entitle: "Custom Packaging and Design", located at <https://salazarpackaging.com/custom-packaging-and-design/>, accessed on Sep. 28, 2017, 2 pgs.

weiku.com; Article entitled: "100% Biodegradable Packing materials Green Cell Foam Stock Coolers", located at <http://www.weiku.com/products/18248504/100_Biodegradable_Packing_materials_Green_Cell_Foam_Stock_Coolers.html>, accessed on Sep. 28, 2017, 7 pgs.

Waltermire, Jamie; Non-Final Office Action for U.S. Appl. No. 15/482,200, filed Apr. 7, 2017, dated Jun. 11, 2018, 36 pgs.

Waltermire, Jamie; Non-Final Office Action for U.S. Appl. No. 15/590,345, filed May 9, 2017, dated Aug. 24, 2018, 41 pgs.

Waltermire, Jamie; Requirement for Restriction/Election for U.S. Appl. No. 15/590,349, filed May 9, 2017, dated Aug. 30, 2018, 10 pgs.

Collison, Alan B.; Requirement for Restriction/Election for U.S. Appl. No. 15/677,738, filed Aug. 15, 2017, dated Jul. 3, 2018, 8 pgs.

Collison, Alan B.; Requirement for Restriction/Election for U.S. Appl. No. 15/677,738, filed Aug. 15, 2017, dated Jul. 31, 2018, 8 pgs.

American Bag Company; Article entitled: "Cool Green Bag, Small", located at <http://hotcoldbags.com/items/Cool%20Green%20Bag,%20Small>, accessed on Mar. 20, 2017, 2 pgs.

Cold Keepers; Article entitled: "Insulated Shipping Boxes—Coldkeepers, Thermal Shipping Solutions", located at <https://www.coldkeepers.com/product-category/shipping/>, (Accessed: Jan. 12, 2017), 3 pgs.

Duro Bag; Article entitled: "The Load and Fold Bag", accessed on May 24, 2017, copyrighted Apr. 2017, 3 pgs.

Greenblue; "Environmental Technical Briefs of Common Packaging Materials—Fiber-Based Materials", Sustainable Packaging Solution, 2009, 19 pgs.

Images of Novolex bag, including an outer paper bag, a corrugated cardboard insert, and an inner foil-covered bubble-wrap bag, publicly available prior to May 9, 2017, 7 pgs.

(56) References Cited

OTHER PUBLICATIONS

MP Global Products, LLC; International Search Report and Written Opinion of the International Searching Authority for PCT/US2017/060403, filed Nov. 7, 2017, dated Feb. 19, 2018, 15 pgs.
MP Global Products; Article entitled: "Thermopod mailer envelopes and Thermokeeper insulated box liners", located at < http://www.mhpn.com/product/thermopod_mailer_envelopes_and_thermokeeper_insulated_box_liners/packaging>, accessed on Aug. 30, 2017, 2 pgs.
Needles 'N' Knowledge; Article entitled: "Tall Box With Lid", located at <http://needlesnknowledge.blogspot.com/2017/10/tall-box-with-lid.html> (Accessed: Jan. 12, 2017), 10 pgs.
Tera-Pak; Article entitled: "Insulated Shipping Containers", located at <http://www.tera-pak.com/>, accessed on Mar. 20, 2017, 3 pgs.
Un Packaging; Article entitled: "CooLiner® Insulated Shipping Bags", available at <http://www.chem-tran.com/packaging/supplies/cooliner-insulated-shipping-bags.php>, accessed on Aug. 30, 2017, 2 pgs.
Waltermire, Jamie; Final Office Action for U.S. Appl. No. 15/482,200, filed Apr. 7, 2017, dated Jan. 2, 2019, 23 pgs.
Waltermire, Jamie; Non-Final Office Action for U.S. Appl. No. 15/590,349, filed May 9, 2017, dated Nov. 5, 2018, 41 pgs.
Collison, Alan B.; Applicant Interview Summary for U.S. Appl. No. 15/677,738, filed Aug. 15, 2017, dated Dec. 5, 2018, 4 pgs.
Collison, Alan B.; Non-Final Office Action for U.S. Appl. No. 15/677,738, filed Aug. 15, 2017, dated Oct. 23, 2018, 11 pgs.
PeriWrap; Article entitled: "Insulated Solutions", located at <https://www.peri-wrap.com/insulation/>, accessed on Dec. 3, 2018, 5 pgs.
Singh, et al; Article entitled: "Performance Comparison of Thermal Insulated Packaging Boxes, Bags and Refrigerants for Single-parcel Shipments", published Mar. 13, 2007, 19 pgs.
Waltermire, Jamie; Final Office Action for U.S. Appl. No. 15/590,345, filed May 9, 2017, dated Mar. 19, 2019, 42 pgs.
Waltermire, Jamie; Requirement for Restriction/Election for U.S. Appl. No. 15/482,186, filed Apr. 7, 2017, dated Apr. 17, 2019, 7 pgs.
Waltermire, Jamie; Requirement for Restriction/Election for U.S. Appl. No. 15/663,905, filed Jul. 31, 2017, dated Mar. 21, 2019, 8 pgs.
Sollie, Greg; Non-Final Office Action for U.S. Appl. No. 15/845,545, filed Dec. 18, 2017, dated Mar. 5, 2019, 41 pgs.
Collison, Alan B.; Final Office Action for U.S. Appl. No. 15/677,738, filed Aug. 15, 2017, dated Feb. 28, 2019, 14 pgs.
Cellulose Material Solutions, LLC; Brochure for Infinity Care Thermal Liner, accessed on Oct. 22, 2018, 2 pgs.
Uline; Article entitled: Corrugated Corner Protectors—4 x 4", accessed on Oct. 25, 2018, 1 pg.
DHL Express; Brochure for Dry Ice Shipping Guidelines, accessed on Oct. 26, 2018, 12 pgs.
Thomas Scientific; Article entitled: "Thermosafe: Test Tube Shipper/Rack", accessed on Oct. 26, 2018, 2 pgs.
Stinson, Elizabeth; Article entitled: "A Pizza Geek Discovers the World's Smartest Pizza Box", published Jan. 17, 2014, 8 pgs.
Waltermire, Jamie; International Search Report and Written Opinion for PCT Application No. PCT/US18/65464, filed Dec. 13, 2018, dated Mar. 11, 2019, 9 pgs.
Sollie, Greg; International Search Report and Written Opinion for PCT Application No. PCT/US18/65461, filed Dec. 31, 2018, dated Mar. 21, 2019, 13 pgs.
Sollie, Greg; International Search Report and Written Opinion for PCT/US18/65463, filed Dec. 13, 2018, dated Mar. 25, 2019, 11 pgs.
Collison, Alan B.; Applicant Interview Summary for U.S. Appl. No. 15/677,738, filed Aug. 15, 2017, dated Apr. 22, 2019, 4 pgs.
Waltermire, Jamie; Supplemental Notice of Allowance for U.S. Appl. No. 15/482,200, filed Apr. 7, 2017, dated Jul. 26, 2019, 9 pgs.
Waltermire, Jamie; Supplemental Notice of Allowance for U.S. Appl. No. 15/482,200, filed Apr. 7, 2017, dated Aug. 12, 2019, 7 pgs.
Sollie, Greg; Requirement for Restriction/Election for U.S. Appl. No. 16/382,710, filed Apr. 12, 2019, dated Jul. 15, 2019, 6 pgs.
PeriWrap; Article entitled: "Insulated Solutions", located at <https://www.peri-wrap.com/insulation/>, accessed on Dec. 3, 2018, 9 pgs.
Collison, Alan B.; Corrected Notice of Allowance for U.S. Appl. No. 15/677,738, filed Aug. 15, 2017, dated Jul. 15, 2019, 7 pgs.
Waltermire, Jamie; Non-Final Office Action for U.S. Appl. No. 15/482,186, filed Apr. 7, 2017, dated Aug. 20, 2019, 81 pgs.
Waltermire, Jamie; Supplemental Notice of Allowance for U.S. Appl. No. 15/482,200, filed Apr. 7, 2017, dated Sep. 10, 2019, 8 pgs.
Waltermire, Jamie; Notice of Allowance for U.S. Appl. No. 15/590,345, filed May 9, 2017, dated Oct. 1, 2019, 28 pgs.
Waltermire, Jamie; Non-Final Office Action for U.S. Appl. No. 15/590,349, filed May 9, 2017, dated Sep. 5, 2019, 25 pgs.
Waltermire, Jamie; Final Office Action for U.S. Appl. No. 15/663,905, filed Jul. 31, 2017, dated Aug. 22, 2019, 23 pgs.
Waltermire, Jamie; Non-Final Office Action for U.S. Appl. No. 16/381,678, filed Apr. 11, 2019, dated Sep. 9, 2019, 50 pgs.
Sollie, Greg; Corrected Notice of Allowance for U.S. Appl. No. 15/845,545, filed Dec. 18, 2017, dated Oct. 1, 2019, 7 pgs.
"Green Cell Foam Shipping Coolers", located at <https://www.greencellfoam.com/shipping-coolers>, accessed on Oct. 18, 2019, 4 pgs.
CooLiner® Insulated Shipping Bags, available at <http://www/chem-tran.com/packaging/supplies/cooliner-insulated-shipping-bags.php>, accessed on Oct. 18, 2019, 4 pgs.
Sollie, Greg; Final Office Action for U.S. Appl. No. 15/988,550, filed May 24, 2018, dated Aug. 14, 2019, 19 pgs.
Sollie, Greg; Non-Final Office Action for U.S. Appl. No. 15/988,550, filed May 24, 2018, dated Oct. 9, 2019, 17 pgs.
Sollie, Greg; Final Office Action for U.S. Appl. No. 16/280,595, filed Feb. 20, 2019, dated Oct. 3, 2019, 19 pgs.
Sollie, Greg; Non-Final Office Action for U.S. Appl. No. 16/530,052, filed Aug. 2, 2019, dated Oct. 2, 2019, 12 pgs.
Sollie, Greg; Non-Final Office Action for U.S. Appl. No. 16/382,710, filed Apr. 12, 2019, dated Oct. 10, 2019, 49 pgs.
Sollie, Greg; Non-Final Office Action for U.S. Appl. No. 16/408,981, filed May 10, 2019, dated Aug. 20, 2019, 50 pgs.
Waltermire, Jamie; Notice of Allowance for U.S. Appl. No. 15/482,200, filed Apr. 7, 2017, dated May 14, 2019, 25 pgs.
Waltermire, Jamie; Final Office Action for U.S. Appl. No. 15/590,349, filed May 9, 2017, dated May 9, 2019, 31 pgs.
Waltermire, Jamie; Non-Final Office Action for U.S. Appl. No. 15/663,905, filed Jul. 31, 2017, dated Jun. 25, 2019, 66 pgs.
Sollie, Greg; Notice of Allowance for U.S. Appl. No. 15/845,545, filed Dec. 18, 2017, dated Jun. 19, 2019, 20 pgs.
Collison, Alan B.; Notice of Allowance for U.S. Appl. No. 15/677,738, filed Aug. 15, 2017, dated Jun. 19, 2019, 10 pgs.
Sollie, Greg; Non-Final Office Action for U.S. Appl. No. 15/988,550, filed May 24, 2018, dated May 29, 2019, 48 pgs.
Sollie, Greg; Non-Final Office Action for U.S. Appl. No. 16/280,595, filed Feb. 20, 2019, dated May 29, 2019, 60 pgs.
Sollie, Greg; International Search Report and Written Opinion for PCT Application No. PCT/US18/65459, filed Dec. 13, 2018, dated May 1, 2019, 15 pgs.
Voluntary Standard for Repulping and Recycling Corrugated Fiberboard Treated to Improve Its Performance in the Presence of Water and Water Vapor. (revises Aug. 16, 2013) Fibre Box Association (FBA), Elk Grove Village, IL, 1-23, Retrieved from http://www.corrugated.org/wp-content/uploads/PDFs/Recycling/Vol_Std_Protocol_2013. pdf, 23 pgs.
Waltermire, Jamie; Non-Final Office Action for U.S. Appl. No. 16/526,511, filed Jul. 30, 2019, dated Dec. 9, 2019, 55 pgs.
Waltermire, Jamie; Non-Final Office Action for U.S. Appl. No. 16/530,045, filed Aug. 2, 2019, dated Dec. 20, 2019, 61 pgs.
Waltermire, Jamie; Supplemental Notice of Allowance for U.S. Appl. No. 15/590,345, filed May 9, 2017, dated Dec. 3, 2019, 14 pgs.
Waltermire, Jamie; Applicant-Initiated Interview Summary for U.S. Appl. No. 15/590,349, filed May 9, 2017, dated Dec. 3, 2019, 3 pgs.
Waltermire, Jamie; Final Office Action for U.S. Appl. No. 15/590,349, filed May 9, 2017, dated Jan. 6, 2020, 26 pgs.
Waltermire, Jamie; Corrected Notice of Allowance for U.S. Appl. No. 15/663,905, filed Jul. 31, 2017, dated Nov. 18, 2019, 6 pgs.
Waltermire, Jamie; Corrected Notice of Allowance for U.S. Appl. No. 15/663,905, filed Jul. 31, 2017, dated Dec. 26, 2019, 7 pgs.

(56) References Cited

OTHER PUBLICATIONS

Waltermire, Jamie; Notice of Allowance for U.S. Appl. No. 15/663,905, filed Jul. 31, 2017, dated Nov. 4, 2019, 18 pgs.
Waltermire, Jamie; Final Office Action for U.S. Appl. No. 16/381,678, filed Apr. 11, 2019, dated Dec. 30, 2019, 17 pgs.
Sollie, Greg; Corrected Notice of Allowance for U.S. Appl. No. 15/845,545, filed Dec. 18, 2017, dated Oct. 31, 2019, 12 pgs.
Collison, Alan B.; Notice of Allowance for U.S. Appl. No. 15/677,738, filed Aug. 15, 2017, dated Oct. 29, 2019, 14 pgs.
Collison, Alan B.; Supplemental Notice of Allowance for U.S. Appl. No. 15/677,738, filed Aug. 15, 2017, dated Dec. 10, 2019, 4 pgs.
Sollie, Greg; Applicant Initiated Interview Summary for U.S. Appl. No. 15/988,550, filed May 24, 2018, dated Dec. 27, 2019, 3 pgs.
Sollie, Greg; Non-Final Office Action for U.S. Appl. No. 16/280,595, filed Feb. 20, 2019, dated Dec. 19, 2019, 23 pgs.
Sollie, Greg; Final Office Action for U.S. Appl. No. 16/530,052, filed Aug. 2, 2019, dated Dec. 27, 2019, 49 pgs.
Sollie, Greg; Non-Final Office Action for U.S. Appl. No. 16/567,192, filed Sep. 11, 2019, dated Dec. 10, 2019, 49 pgs.
Waltermire, Jamie; Corrected Notice of Allowance for U.S. Appl. No. 15/590,345, filed May 9, 2017, dated Feb. 18, 2020, 9 pgs.
Waltermire, Jamie; Supplemental Notice of Allowance for U.S. Appl. No. 15/590,345, filed May 9, 2017, dated Jan. 9, 2020, 8 pgs.
Waltermire, Jamie; Requirement for Restriction/Election for U.S. Appl. No. 16/526,555, filed Jul. 30, 2019, dated Jan. 17, 2020, 7 pgs.
Sollie, Greg; Applicant-Initiated Interview Summary for U.S. Appl. No. 16/530,052, filed Aug. 2, 2019, dated Feb. 5, 2020, 2 pgs.
Sollie, Greg; Requirement for Restriction/Election for U.S. Appl. No. 16/401,603, filed May 2, 2019, dated Feb. 18, 2020, 6 pgs.
Sollie, Greg; International Search Report and Written Opinion for PCT Application No. PCT/US19/60486, filed Nov. 18, 2019, dated Jan. 13, 2020, 10 pgs.
Sollie, Greg; Invitation to Pay Additional Fees for PCT/US19/59764, filed Nov. 5, 2019, mailed Jan. 2, 2020, 2 pgs.
Sollie, Greg; Final Office Action for U.S. Appl. No. 16/408,981, filed May 10, 2019, dated Feb. 24, 2020, 29 pgs.
Waltermire, Jamie; Notice of Allowance for U.S. Appl. No. 15/482,186, filed Apr. 7, 2017, dated Mar. 5, 2020, 29 pgs.
Waltermire, Jamie; Non-Final Office Action for U.S. Appl. No. 16/293,716, filed Mar. 6, 2019, dated May 5, 2020, 70 pgs.
Waltermire, Jamie; Requirement for Restriction/Election for U.S. Appl. No. 16/293,716, filed Mar. 6, 2019, dated Feb. 26, 2020, 6 pgs.
Waltermire, Jamie; Non-Final Office Action for U.S. Appl. No. 16/526,555, filed Jul. 30, 2019, dated Apr. 2, 2020, 63 pgs.
Waltermire, Jamie; Advisory Action for U.S. Appl. No. 16/381,678, filed Apr. 11, 2019, dated Feb. 26, 2020, 3 pgs.
Waltermire, Jamie; Non-Final Office Action for U.S. Appl. No. 16/381,678, filed Apr. 11, 2019, dated Apr. 17, 2020, 30 pgs.
Waltermire, Jamie; Non-Final Office Action for U.S. Appl. No. 16/561,203, filed Sep. 5, 2019, dated May 6, 2020, 59 pgs.
Waltermire, Jamie; Requirement for Restriction/Election for U.S. Appl. No. 16/561,203, filed Sep. 5, 2019, dated Feb. 26, 2020, 5 pgs.
Sollie, Greg; Restriction Requirement for U.S. Appl. No. 16/552,277, filed Aug. 27, 2019, dated Apr. 20, 2020, 7 pgs.
Sollie, Greg; Non-Final Office Action for U.S. Appl. No. 15/988,550, filed May 24, 2018, dated Mar. 11, 2020, 35 pgs.
Sollie, Greg; Applicant-Initiated Interview Summary for U.S. Appl. No. 16/280,595, filed Feb. 20, 2019 dated May 6, 2020, 3 pgs.
Sollie, Greg; Final Office Action for U.S. Appl. No. 16/280,595, filed Feb. 20, 2019, dated Mar. 24, 2020, 20 pgs.
Sollie, Greg; Non-Final Office Action for U.S. Appl. No. 16/530,052, filed Aug. 2, 2019, dated Mar. 3, 2020, 24 pgs.
Sollie, Greg; Non-Final Office Action for U.S. Appl. No. 16/401,603, filed May 2, 2019, dated Mar. 10, 2020, 67 pgs.
Sollie, Greg; Final Office Action for U.S. Appl. No. 16/382,710, filed Apr. 12, 2019, dated Apr. 6, 2020, 33 pgs.
Waltermire, Jamie; Corrected Notice of Allowance for U.S. Appl. No. 15/482,186, filed Apr. 7, 2017, dated Jun. 2, 2020, 10 pgs.
Waltermire, Jamie; Applicant-Initiated Interview Summary for U.S. Appl. No. 16/526,511, filed Jul. 30, 2019, dated Jun. 12, 2020, 5 pgs.
Waltermire, Jamie; Final Office Action for U.S. Appl. No. 16/526,511, filed Jul. 30, 2019, dated May 19, 2020, 39 pgs.
Waltermire, Jamie; Non-Final Office Action for U.S. Appl. No. 16/526,511, filed Jul. 30, 2019, dated Jul. 10, 2020, 23 pgs.
Waltermire, Jamie; Applicant-Initiated Interview Summary for U.S. Appl. No. 16/530,045, filed Aug. 2, 2019, dated Jun. 15, 2020, 3 pgs.
Waltermire, Jamie; Non-Final Office Action for U.S. Appl. No. 16/530,045, filed Aug. 2, 2019, dated May 27, 2020, 38 pgs.
Waltermire, Jamie; Non-Final Office Action for U.S. Appl. No. 15/590,349, filed May 9, 2017, dated Jun. 12, 2020, 30 pgs.
Waltermire, Jamie; Final Office Action for U.S. Appl. No. 16/381,678, filed Apr. 11, 2019, dated Jun. 16, 2020, 8 pgs.
Sollie, Greg; Non-Final Office Action for U.S. Appl. No. 16/552,277, filed Aug. 27, 2019, dated Jun. 3, 2020, 68 pgs.
Collison, Alan B.; Applicant Interview Summary for U.S. Appl. No. 16/658,756, filed Oct. 21, 2019, dated May 6, 2020, 3 pgs.
Collison, Alan B.; Applicant Interview Summary for U.S. Appl. No. 16/658,756, filed Oct. 21, 2019, dated Jun. 29, 2020, 3 pgs.
Collison, Alan B.; Final Office Action for U.S. Appl. No. 16/658,756, filed Oct. 21, 2019, dated Jun. 17, 2020, 10 pgs.
Collison, Alan B.; Non-Final Office Action for U.S. Appl. No. 16/658,756, filed Oct. 21, 2019, dated Feb. 4, 2020, 14 pgs.
MP Global Products LLC: European Search Report for serial No. 17868605.1, dated Mar. 16, 2020, 7 pgs.
Collison, Alan B.; Non-Final Office Action for U.S. Appl. No. 16/414,309, filed May 16, 2019, dated Jul. 17, 2020, 77 pgs.
Collison, Alan B.; Requirement for Restriction/Election for U.S. Appl. No. 16/414,309, filed May 16, 2019, dated Jun. 16, 2020, 5 pgs.
Collison, Alan B.; Non-Final Office Action for U.S. Appl. No. 16/414,310, filed May 16, 2019, dated Jul. 8, 2020, 84 pgs.
Sollie, Greg; Advisory Action for U.S. Appl. No. 16/280,595, filed Feb. 20, 2019, dated Jul. 6, 2020, 3 pgs.
Sollie, Greg; Applicant-Initiated Interview Summary for U.S. Appl. No. 16/401,603, filed May 2, 2019, dated May 15, 2020, 3 pgs.
Sollie, Greg; Final Office Action for U.S. Appl. No. 16/401,603, filed May 2, 2019, dated Jun. 30, 2020, 13 pgs.
Sollie, Greg; Notice of Allowance for U.S. Appl. No. 16/382,710, filed Apr. 12, 2019, dated Jun. 3, 2020, 12 pgs.
Sollie, Greg; Final Office Action for U.S. Appl. No. 16/567,192, filed Sep. 11, 2019, dated Jun. 8, 2020, 20 pgs.
Sollie, Greg; International Preliminary Report on Patentability for PCT Application No. PCT/US18/65459, filed Dec. 13, 2018, dated Jul. 2, 2020, 11 pgs.
Sollie, Greg; International Preliminary Report on Patentability for PCT Application No. PCT/US18/65461, filed Dec. 13, 2018, dated Jul. 2, 2020, 12 pgs.
Sollie, Greg; International Search Report and Written Opinion for PCT Application No. PCT/US20/24820, filed Mar. 26, 2020, dated Jul. 2, 2020, 14 pgs.
Sollie, Greg; International Search Report and Written Opinion for PCT Application No. PCT/US19/59764, filed Nov. 5, 2019, dated Jul. 1, 2020, 13 pgs.
Waltermire, Jamie; Corrected Notice of Allowance for U.S. Appl. No. 15/482,186, filed Apr. 7, 2017, dated Sep. 2, 2020, 12 pgs.
Waltermire, Jamie; Notice of Allowance for U.S. Appl. No. 16/526,511, filed Jul. 30, 2019, dated Mar. 14, 2020, 18 pgs.
Waltermire, Jamie; Final Office Action for U.S. Appl. No. 16/293,716, filed Mar. 6, 2019, dated Mar. 10, 2020, 24 pgs.
Waltermire, Jamie; Final Office Action for U.S. Appl. No. 16/381,678, filed Apr. 11, 2019, dated Mar. 20, 2020, 21 pgs.
Waltermire, Jamie; Notice of Allowance for U.S. Appl. No. 16/381,678, filed Apr. 11, 2019, dated Jul. 30, 2020, 15 pgs.
Waltermire, Jamie; Final Office Action for U.S. Appl. No. 16/561,203, filed Nov. 15, 2019, dated Mar. 10, 2020, 25 pgs.
Waltermire, Jamie; Requirement for Restriction/Election for U.S. Appl. No. 16/689,433, filed Nov. 20, 2019, dated Oct. 16, 2020, 6 pgs.
Sollie, Greg; Final Office Action for U.S. Appl. No. 16/552,277, filed Aug. 27, 2019, dated Aug. 7, 2020, 19 pgs.

(56) References Cited

OTHER PUBLICATIONS

Sollie, Greg; Notice of Allowance for U.S. Appl. No. 16/552,277, filed Aug. 27, 2019, dated Aug. 31, 2020, 6 pgs.
Collison, Alan B.; Applicant-Initiated Interview Summary for U.S. Appl. No. 16/414,309, filed May 16, 2019, dated Aug. 21, 2020, 3 pgs.
Collison, Alan B.; Applicant-Initiated Interview Summary for U.S. Appl. No. 16/414,309, filed May 16, 2019, dated Oct. 15, 2020, 3 pgs.
Collison, Alan B.; Final Office Action for U.S. Appl. No. 16/414,309, filed May 16, 2019, dated Oct. 8, 2020, 15 pgs.
Collison, Alan B.; Applicant-Initiated Interview Summary for U.S. Appl. No. 16/414,310, filed May 16, 2019, dated Jul. 30, 2020, 3 pgs.
Collison, Alan; Final Office Action for U.S. Appl. No. 16/414,310, filed May 16, 2019, dated Oct. 13, 2020, 30 pgs.
Sollie, Greg; Final Office Action for U.S. Appl. No. 15/988,550, filed May 24, 2018, dated Aug. 27, 2020, 27 pgs.
Sollie, Greg; Non-Final Office Action for U.S. Appl. No. 16/280,595, filed Feb. 20, 2019, dated Aug. 28, 2020, 26 pgs.
Sollie, Greg; Final Office Action for U.S. Appl. No. 16/530,052, filed Aug. 2, 2019, dated Aug. 28, 2020, 29 pgs.
Sollie, Greg; Notice of Allowance for U.S. Appl. No. 16/401,603, filed May 2, 2019, dated Aug. 31, 2020, 14 pgs.
Sollie, Greg; Non-Final Office Action for U.S. Appl. No. 16/401,607, filed May 2, 2019, dated Aug. 19, 2020, 38 pgs.
Sollie, Greg; Corrected Notice of Allowance for U.S. Appl. No. 16/382,710, filed Apr. 12, 2019, dated Sep. 24, 2020, 9 pgs.
Sollie, Greg; Notice of Allowance for U.S. Appl. No. 16/567,192, filed Sep. 11, 2019, dated Aug. 7, 2020, 14 pgs.
Sollie, Greg; Non-Final Office Action for U.S. Appl. No. 16/408,981, filed May 10, 2019, dated Sep. 16, 2020, pgs.
MP Global Products LLC: European Search Report Response for serial No. 17868605.1, filed Oct. 2, 2020, 15 pgs.
Waltermire, Jamie; Corrected Notice of Allowance for U.S. Appl. No. 16/526,511, filed Jul. 30, 2019, dated Oct. 30, 2020, 14 pgs.
Waltermire, Jamie; Corrected Notice of Allowance for U.S. Appl. No. 16/526,511, filed Jul. 30, 2019, dated Nov. 30, 2020, 9 pgs.
Waltermire, Jamie; Final Office Action for U.S. Appl. No. 16/530,045, filed Aug. 2, 2019, dated Nov. 24, 2020, 40 pgs.
Waltermire, Jamie; Non-Final Office Action for U.S. Appl. No. 16/164,933, filed Oct. 19, 2018, dated Nov. 18, 2020, 104 pgs.
Waltermire, Jamie; Corrected Notice of Allowance for U.S. Appl. No. 15/590,349, filed May 9, 2017, dated Nov. 2, 2020, 9 pgs.
Waltermire, Jamie; Notice of Allowance for U.S. Appl. No. 15/590,349, filed May 9, 2017, dated Oct. 20, 2020, 20 pgs.
Waltermire, Jamie; Final Office Action for U.S. Appl. No. 16/293,716, filed Mar. 6, 2019, dated Oct. 29, 2020, 19 pgs.
Waltermire, Jamie; Non-Final Office Action for U.S. Appl. No. 16/526,555, filed Jul. 30, 2019, dated Oct. 27, 2020, 39 pgs.
Waltermire, Jamie; Final Office Action for U.S. Appl. No. 16/381,678, filed Apr. 11, 2019, dated Oct. 19, 2020, 24 pgs.
Waltermire, Jamie; Notice of Allowance for U.S. Appl. No. 16/561,203, filed Sep. 5, 2019, dated Nov. 3, 2020, 14 pgs.
Waltermire, Jamie; Requirement for Restriction/Election for U.S. Appl. No. 16/689,407, filed Nov. 20, 2019, dated Oct. 29, 2020, 6 pgs.
Sollie, Greg; Corrected Notice of Allowance for U.S. Appl. No. 16/552,277, filed Aug. 27, 2019, dated Nov. 5, 2020, 9 pgs.
Collison, Alan B.; Advisory Action for U.S. Appl. No. 16/658,756, filed Oct. 21, 2019, dated Sep. 25, 2020, 4 pgs.
Collison, Alan B.; Notice of Allowance for U.S. Appl. No. 16/658,756, filed Oct. 21, 2019, dated Oct. 23, 2020, 10 pgs.
Collison, Alan B.; Corrected Notice of Allowance for U.S. Appl. No. 16/414,309, filed May 16, 2019, dated Nov. 16, 2020, 10 pgs.
Collison, Alan B.; Corrected Notice of Allowance for U.S. Appl. No. 16/414,309, filed May 16, 2019, dated Nov. 27, 2020, 9 pgs.
Collison, Alan B.; Notice of Allowance for U.S. Appl. No. 16/414,309, filed May 16, 2019, dated Oct. 21, 2020, 6 pgs.
Collison, Alan B.; Notice of Allowance for U.S. Appl. No. 16/414,310, filed May 16, 2019, dated Nov. 13, 2020, 15 pgs.
Sollie, Greg; Corrected Notice of Allowance for U.S. Appl. No. 16/401,603, filed May 21, 2019, dated Nov. 24, 2020, 8 pgs.
Sollie, Greg; Corrected Notice of Allowance for U.S. Appl. No. 16/401,603, filed May 2, 2019, dated Nov. 3, 2020, 9 pgs.
Sollie, Greg; Notice of Allowance for U.S. Appl. No. 16/382,710, filed Apr. 12, 2019, dated Oct. 21, 2020, 5 pgs.
Sollie, Greg; Corrected Notice of Allowance for U.S. Appl. No. 16/567,192, filed Sep. 11, 2019, dated Oct. 20, 2020, 8 pgs.
Waltermire, Jamie; Certificate of Correction for U.S. Appl. No. 15/482,186, filed Apr. 7, 2017, dated Dec. 29, 2020, 1 pg.
Waltermire, Jamie; Corrected Notice of Allowance for U.S. Appl. No. 15/590,349, filed May 9, 2017, dated Dec. 33, 3030, 9 pgs.
Waltermire, Jamie; Corrected Notice of Allowance for U.S. Appl. No. 16/561,203, filed Sep. 5, 2019, dated Jan. 5, 2021, 9 pgs.
Waltermire, Jamiel Non-Final Office Action for U.S. Appl. No. 16/689,407, filed Nov. 20, 2019, dated Jan. 8, 2021, 92 pgs.
Sollie, Greg; Corrected Notice of Allowance for U.S. Appl. No. 16/552,277, filed Aug. 27, 2019, dated Dec. 22, 2020, 7 pgs.
Collison, Alan B.; Supplemental Notice of Allowance for U.S. Appl. No. 16/414,310, filed May 16, 2019, dated Dec. 3, 2020, 8 pgs.
Sollie, Greg; Applicant-Initiated Interview Summary for U.S. Appl. No. 15/988,550, filed May 24, 2018, dated Dec. 24, 2020, 2 pgs.
Sollie, Greg; Final Office Action for U.S. Appl. No. 16/280,595, filed Feb. 20, 2019, filed Feb. 20, 2019, dated Dec. 30, 2020, 25 pgs.
Sollie, Greg; Non-Final Office Action for U.S. Appl. No. 16/530,052, filed Aug. 2, 2019, dated Dec. 18, 2020, 17 pgs.
Sollie, Greg; Corrected Notice of Allowance for U.S. Appl. No. 16/401,607, filed May 2, 2019, dated Jan. 4, 2021, 9 pgs.
Sollie, Greg; Notice of Allowance for U.S. Appl. No. 16/401, 607, filed May 2, 2019, dated Dec. 4, 2020, 12 pgs.
Sollie, Greg; Final Office Action for U.S. Appl. No. 16/408,981, filed May 10, 2019, dated Dec. 29, 2020, 22 pgs.
Sollie, Greg; Requirement for Restriction/Electrion for U.S. Appl. No. 16/886,040, filed May 28, 2020, dated Dec. 23, 2020, 6 pgs.
MP Global Products, LLC, First Examination Report for Australian patent application No. 2017359035, filed Nov. 7, 2017, dated Nov. 27, 2020, 3 pgs.

* cited by examiner

INSULATED BLOCK PACKAGING ASSEMBLY

TECHNICAL FIELD

This disclosure relates to packaging. More specifically, this disclosure relates to insulative packaging.

BACKGROUND

Packaging and shipping temperature sensitive contents can pose challenges. The contents can spoil, destabilize, freeze, melt, or evaporate during storage or shipping if the temperature of the contents is not maintained or the packaging is not protected from hot or cold environmental conditions. Demands are particularly stringent with consideration of pharmaceutical handling, where maintaining a required temperature is often essential to prevent destruction of the item to be shipped. Temperature maintenance packaging solutions currently in place are often fragile, complex, cumbersome, ineffective, or difficult to assemble, or simply maintain temperatures for too short of a time.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

A packaging assembly includes a pair of first insulation blocks, each first insulation block being rectangular having six surfaces including a first pair of opposing surfaces, a second pair of opposing surfaces, and a third pair of opposing surfaces, each first insulation block defined of a first dimension as measured between the third pair of opposing surfaces, each first insulation block defined of a second dimension as measured between the first pair of opposing surfaces, and each first insulation block defined of a third dimension as measured between the second pair of opposing surfaces, the first dimension of the first insulation block being a thickness; a pair of second insulation blocks, each second insulation block being rectangular having six surfaces including a first pair of opposing surfaces, a second pair of opposing surfaces, and a third pair of opposing surfaces, each second insulation block defined of a first dimension as measured between the second pair of opposing surfaces, each second insulation block defined of a second dimension as measured between the first pair of opposing surfaces, and each second insulation block defined of a third dimension as measured between the third pair of opposing surfaces, the third dimension being a thickness that is about the same as the thickness of each first insulation block; a pair of third insulation blocks, each third insulation block being rectangular having six surfaces including a first pair of opposing surfaces, a second pair of opposing surfaces, and a third pair of opposing surfaces, each third insulation block defined of a first dimension as measured between the second pair of opposing surfaces, each third insulation block defined of a second dimension as measured between the third pair of opposing surfaces, and each third insulation block defined of a third dimension as measured between the first pair of opposing surfaces, the second dimension being a thickness that is about the same as the thickness of the first insulation blocks and of the second insulation blocks; a first enclosure, the first enclosure including a first side, a second side, a third side, a fourth side, and a top side, the first side connected to the third side and the fourth side, the first side opposing the second side, the second side also connected to the third side and the fourth side, and the first side, second side, third side, and fourth side connected to the top side to define a void within the first enclosure; wherein each second surface of each first insulation block abuts one third surface of each second insulation block proximate ends of each second insulation block to define a rectangle having about constant thickness being the same as the thickness of the first, second, and third insulation blocks, wherein the defined rectangle is arranged abutting the pair of third insulation blocks such that each first surface of each first insulation block and each first surface of each second insulation block contacts one third surface of one third insulation block proximate an end of the third insulation block, the insulation blocks defining a subassembly of insulation blocks, wherein the subassembly defines a void, and wherein the subassembly is arranged within the void of the first enclosure.

A packaging assembly includes a pair of first insulation blocks, each first insulation block being rectangular having six surfaces including a first pair of opposing surfaces, a second pair of opposing surfaces, and a third pair of opposing surfaces, each first insulation block defined of a first dimension as measured between the third pair of opposing surfaces, each first insulation block defined of a second dimension as measured between the first pair of opposing surfaces, and each first insulation block defined of a third dimension as measured between the second pair of opposing surfaces, the first dimension of the first insulation block being a thickness; a pair of second insulation blocks, each second insulation block being rectangular having six surfaces including a first pair of opposing surfaces, a second pair of opposing surfaces, and a third pair of opposing surfaces, each second insulation block defined of a first dimension as measured between the second pair of opposing surfaces, each second insulation block defined of a second dimension as measured between the first pair of opposing surfaces, and each second insulation block defined of a third dimension as measured between the third pair of opposing surfaces, the third dimension being a thickness that is about the same as the thickness of each first insulation block; a pair of third insulation blocks, each third insulation block being rectangular having six surfaces including a first pair of opposing surfaces, a second pair of opposing surfaces, and a third pair of opposing surfaces, each third insulation block defined of a first dimension as measured between the second pair of opposing surfaces, each third insulation block defined of a second dimension as measured between the third pair of opposing surfaces, and each third insulation block defined of a third dimension as measured between the first pair of opposing surfaces, the second dimension being a thickness that is about the same as the thickness of the first insulation blocks and of the second insulation blocks; a first enclosure, the first enclosure including a first side, a second side, a third side, a fourth side, and a top side, the first side connected to the third side and the fourth side, the first side opposing the second side, the second side also connected to the second side and the fourth side, and at least one of the first side, second side, third side, and fourth side connected to the top side; wherein the first enclosure is arranged in a collapsed form, and wherein each first insulation block, second insulation block, and third insulation block are arranged on top of and abutting the collapsed first enclosure.

A packaging method includes obtaining a packaging assembly, the packaging assembly including two first insulation blocks, two second insulation blocks, two third insulation blocks, and a first enclosure; arranging an end of each first insulation block contacting a side of one second insulation block proximate an end of the second insulation block to define a rectangular block arrangement; arranging the rectangular block arrangement on top of and contacting one side of one third insulation block to define a packaging subassembly, the subassembly defining a void; arranging the other third insulation block on top of and contacting the rectangular subassembly, the third insulation block assembly enclosing the void of the subassembly; and arranging the first enclosure surrounding the subassembly and the third insulation block.

Various implementations described in the present disclosure can include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations can be realized and obtained by means of the systems, methods, features particularly pointed out in the appended claims. These and other features will become more fully apparent from the following description and appended claims, or can be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures can be designated by matching reference characters for the sake of consistency and clarity.

DETAILED DESCRIPTION

Figure 1:
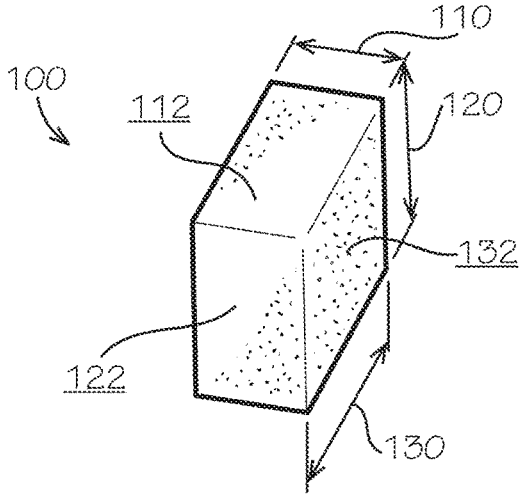
FIG. 1 is a perspective view of an insulation block in accord with one aspect of the current disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a packaging system including insulative blocks that can be combined with various packaging elements to form an insulated packaging solution. In various aspects, the packaging can be used in various applications, including pharmaceutical packaging and shipping. In such applications, temperature sensitivity of the product that is packaged can require the packaging to meet high standards regarding heat transfer. However, at the same time, the ability to form packaging and/or to package the items quickly, efficiently, and cost-effectively is a consideration in choosing the preferred packaging.

As seen with reference to FIG. 1, a first insulation block 100 is disclosed. The first insulation block can be rectangular in shape including a first dimension 110, a second dimension 120, and a third dimension 130. The first insulation block 100 can include a pair of opposing first surfaces 112, 114 (not shown in this view), a pair of opposing second surfaces 122, 124 (not shown in this view), and a pair of opposing third surfaces 132,134 (not shown in this view).

Figure 2:
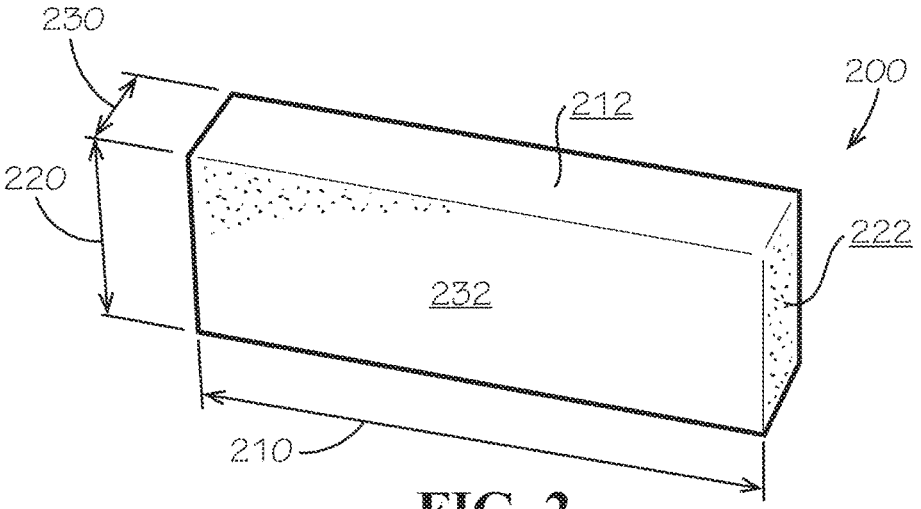
FIG. 2 is a perspective view of an insulation block in accord with one aspect of the current disclosure.

As seen with reference to FIG. 2, a second insulation block 200 is disclosed. The second insulation block can be rectangular in shape including a first dimension 210, a second dimension 220, and a third dimension 230. The second insulation block 200 can includes a pair of opposing first surfaces 212, 214 (not shown in this view), a pair of opposing second surfaces 222, 224 (not shown in this view), and a pair of opposing third surfaces 232, 234 (not shown in this view).

Figure 3:
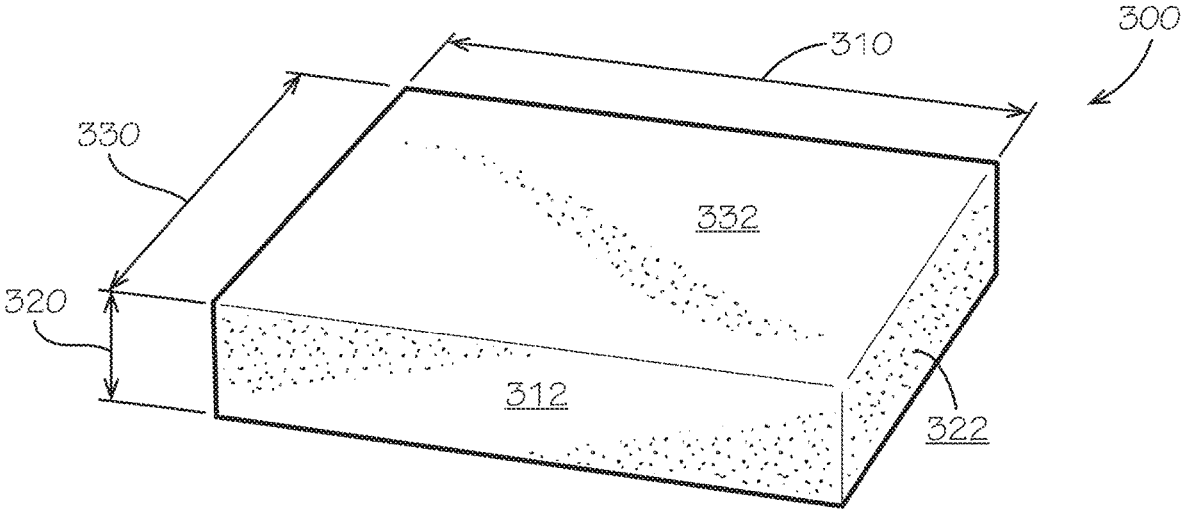
FIG. 3 is a perspective view of an insulation block in accord with one aspect of the current disclosure.

As seen with reference to FIG. 3, a third insulation block 300 is disclosed. The third insulation block can be rectangular in shape including a first dimension 310, a second dimension 320, and a third dimension 330. The third insulation block 300 can include a pair of opposing first surfaces 312, 314 (not shown in this view), a pair of opposing second surfaces 322, 324 (not shown in this view), and a pair of opposing third surfaces 332, 334 (not shown in this view).

In the current aspect, various insulation blocks 100,200, 300 are intended to be oriented in abutting relationships such that dimensions of the various blocks are meant to be coordinated. For example, first dimension 210 can be about the same as first dimension 310, as these parts are meant to align when in assembly. Similarly, second dimension 120 can be about the same as second dimension 220. In various aspects, the various dimensions can be of varying lengths, and specific relationships of the specific parts is not intended to be limiting on the scope of the disclosure.

Each insulation block 100, 200, 300 can be made of insulative material. In the current aspect, the insulative material can be loose fill insulation such as paper, cellulose, or various foam materials such as polystyrene. In various aspects, the insulative material can be open-cell or closed-cell foams. In various aspects, the insulative material can be loose fill, batt, board, or other applications. In the currently disclosed aspect, the loose fill material can be enclosed using a film, in particular, kraft paper. In various aspects, additional films or enclosures can be used, such as plastic film, wax, wax-coated paper, various papers, envelopes such as a paper or cardboard, and combinations thereof. In various aspects, combinations of the above-described elements can be utilized. It should be understood that particular articulations of insulative material and construction of insulation blocks 100,200,300 are not limiting on the scope of this disclosure.

Figure 4:
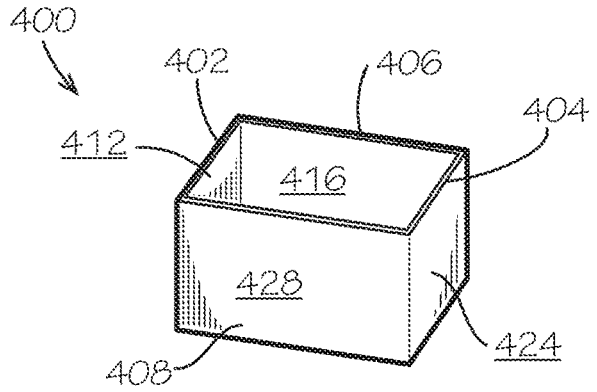
FIG. 4 is a perspective view of an inner box in accord with one aspect of the current disclosure.

With reference to FIG. 4, an inner box 400 can be included. The inner box 400 as currently described includes a first side 402, a second side 404, a third side 406, a fourth side 408, and a bottom side 409 (not shown in the current view). The inner box 400 of the current aspect does not include a top side; however, the disclosure contemplates a top side of the inner box 400 can be included in various aspects and configurations. Each side 402,404,406,408,409 of the inner box 400 can include an inner facing surface and an outer facing surface. The first side 402 can include an inner surface 412 and an outer surface 422 (not shown in the current view). The second side 404 can include an inner surface 414 (not shown in the current view) and an outer surface 424. The third side 406 can include an inner surface 416 and an outer surface 426 (not shown in the current view). The fourth side 408 can include an inner surface 418 (not shown in the current view) and an outer surface 428. The bottom side 409 (not shown in the current view) can includes an inner surface 419 (not shown in the current view) and an outer surface 429 (not shown in the current view). In various aspects, the inner box 400 can be formed of cardboard or various configurations of paperboard products. In various aspects, the inner box 400 can be formed of plastic, paper, metallic, wooden, or firm foam components. In various aspects, the inner box 400 can be formed of corrugated cardboard.

Figure 5:
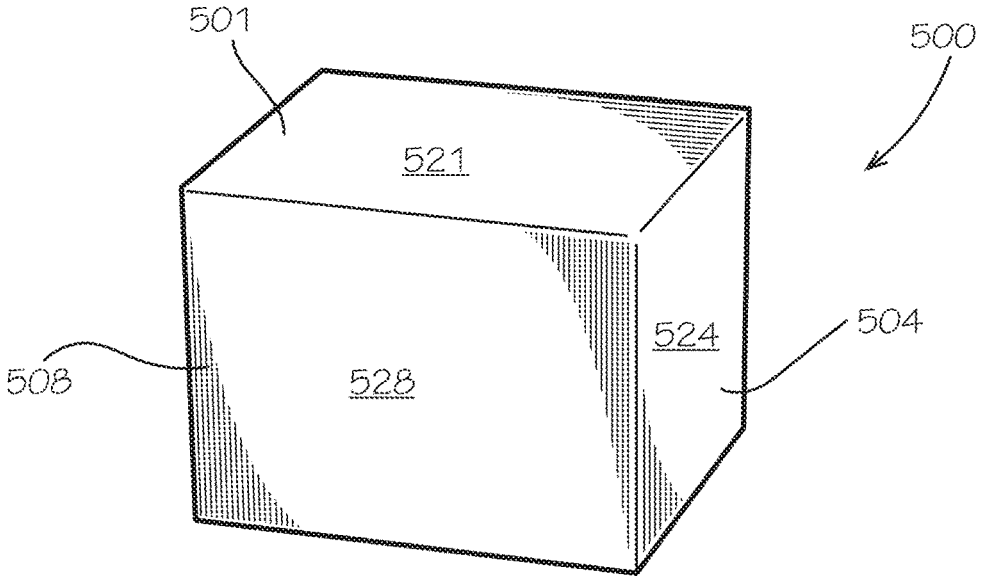
FIG. 5 is a perspective view of a first enclosure in accord with one aspect of the current disclosure.

A first enclosure 500 is disclosed with reference to FIG. 5. In various aspects, the first enclosure 500 can be formed of cardboard or various configurations of paperboard products. In various aspects, the first enclosure 500 can be formed of plastic, paper, metallic, wooden, or firm foam components. In various aspects, the first enclosure 500 can be formed of corrugated cardboard. The first enclosure 500 can include a top side 501, a first side 502 (not shown in the current view), a second side 504, a third side 506 (not shown in the current view), and a fourth side 508. The first enclosure 500 of the current disclosure does not include a bottom side; however, the inclusion of a bottom side is contemplated within the scope of the current disclosure. Each side 501,502,504,506,508 of the first enclosure 500 can include an inner facing surface and an outer facing surface. Top side 501 can include inner surface 511 (not shown in the current view) and outer surface 521. First side 502 (not shown in the current view) can include inner surface 512 (not shown in the current view) and outer surface 522 (not shown in the current view). Second side 504 can include inner surface 514 (not shown in the current view) and outer surface 524. Third side 506 (not shown in the current view) can include inner surface 516 (not shown in the current view) and outer surface 526 (not shown in the current view). Fourth side 508 can include inner surface 518 (not shown in the current view) and outer surface 528.

Figure 6:
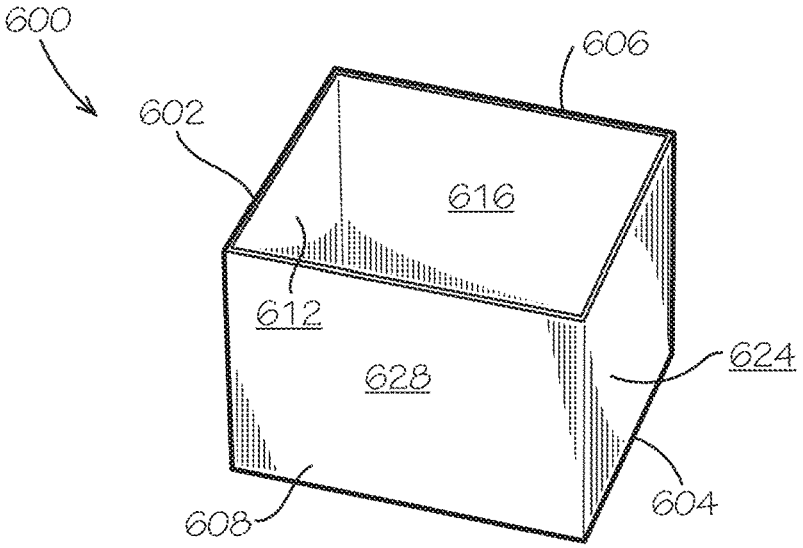
FIG. 6 is a perspective view of a second enclosure in accord with one aspect of the current disclosure.

A second enclosure 600 is disclosed with reference to FIG. 6. The second enclosure 600 can be generally similar in size and shape to first enclosure 500. In the current aspect, the second enclosure 600 can be sized and oriented such that it engages with the first enclosure 500 in mating relationship.

In various aspects, the second enclosure 600 can be formed of cardboard or various configurations of paperboard products. In various aspects, the second enclosure 600 can be formed of plastic, paper, metallic, wooden, or firm foam components. In various aspects, the second enclosure 600 can be formed of corrugated cardboard. In the current aspect, the second enclosure 600 can include a first side 602, a second side 604, a third side 606, a fourth side 608, and a bottom side 609 (not shown in the current view). The first side 602 can include inner surface 612 and outer surface 622 (not shown in the current view). The second side 604 can include inner surface 614 (not shown in the current view) and outer surface 624. The third side 606 can include inner surface 616 and outer surface 626 (not shown in the current view). The fourth side 608 can include inner surface 618 (not shown in the current view) and outer surface 628. The bottom side 609 (not shown in the current view) can include inner surface 619 (not shown in the current view) and outer surface 629 (not shown in the current view).

Figure 7:
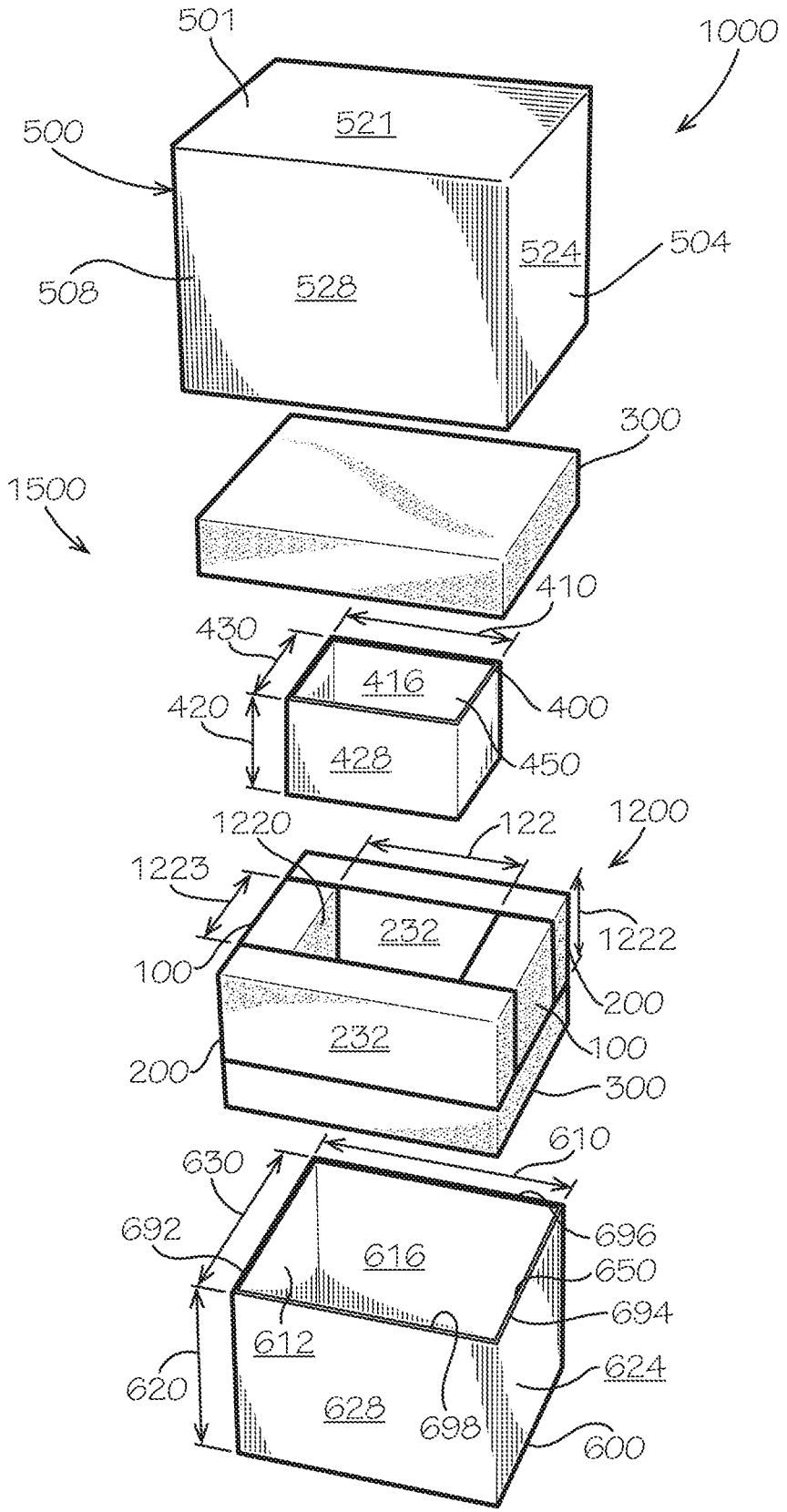
FIG. 7 is an exploded perspective view of a packaging assembly in accord with one aspect of the current disclosure.

As annotated with reference to FIG. 7, a packaging assembly 1000 can include among its parts a subassembly 1200. Subassembly 1200 can include a combination of first insulation blocks 100, second insulation blocks 200, and third insulation blocks 300. In the current aspect, subassembly 1200 can include two first insulation blocks 100, two second insulation blocks 200, and one third insulation block 300. In the current aspect, the various blocks 100, 200, 300 can be arranged such that the two first insulation blocks 100 are parallel to each other in spatial alignment. The second insulation blocks 200 can be arranged orthogonally to first insulation blocks 100. The second surfaces 122, 124 of each first insulation block 100 can abut second insulation blocks 200 at third surfaces 232, 234. The abutting arrangement of the first insulation blocks 100 and the second insulation blocks 200 can define a rectangular block arrangement. The rectangular block arrangement of the four insulation blocks (two first insulation blocks 100 and two second insulation blocks 200) can be arranged on top of third insulation block 300. The rectangular block arrangement can be oriented abutting the third surface 332 of third insulation block 300 such that the first surfaces 114 of first insulation blocks 100 and the first surfaces 214 of second insulation blocks 200 can abut the third surface 332 of the third insulation block 300. The assembled combination of first insulation blocks 100, second insulation blocks 200, and a single third insulation block 300 can compose what is termed the subassembly 1200. In the current aspect of the disclosure, the subassembly 1200 is not joined and does not include any mechanical fastening means. However, mechanical fasteners such as adhesives can be utilized in various aspects. In various aspects, adhesives utilized in joining various elements of the subassembly 1200 can be sealing elements, such that subassembly 1200 can be mechanically sealed to prevent convective heat transfer along the joints. In various aspects, mechanical fasteners such as screws, nails, staples, or other apparatus can be utilized to join the various elements of subassembly 1200. In various aspects, modifications of the insulation blocks 100, 200, 300 can include key/fit features to allow mechanical interference fits. However, the subassembly 1200 of the current disclosure can be assembled without fastening or joining means other than any friction that can naturally occur from interaction of the elements of the subassembly 1200. Subassembly 1500 can include subassembly 1200 along with inner box 400 and another insulation block 300.

In the arrangement of FIG. 7, the subassembly 1200 can define a void 1220 defining a first dimension 1221 that can be about equal to first dimension 210 minus double the length of first dimension 110. The void 1220 can define a second dimension 1222 that can be about the same as second dimension 120 and second dimension 220 in the current aspect. The void 1220 can define a third dimension 1223 that can be about the same as the third dimension 130. As such, the defined void 1220 can be rectangular in shape and generally can be defined by the dimensions of insulation blocks 100, 200, and 300. Similarly, inner box 400 can include first dimension 410, second dimension 420, and third dimension 430. These dimensions can be about the same as first dimension 1221, second dimension 1222, and third dimension 1223, such that the inner box 400 can fit snugly into the void 1220. The inner box 400 can also defines its own void 450 being of a dimension about the same as that of the void 1220 but smaller than the void 1220 by about the thickness of the material used to form the inner box 400. Similarly, second enclosure 600 can define a void 650 along its inner surfaces 612, 614, 616, 618. Similarly, the first enclosure 500 can define a void (not visible in the current view) along its inner surfaces. Second enclosure 600 can include a first dimension 610 that is about the same as first dimension 210. Second enclosure 600 can include a second dimension 620 that is about equal to a combination the length of second dimension 220 and double the length of second dimension 320. Second enclosure 600 can also include a third dimension 620 that can be about equal to a combination of the length of third dimension 130 and double the length of third dimension 230. As such, the subassembly 1500 can fit snugly into the void 650. Further, first enclosure 500 can define a similar void 550 (not shown in the current view) that can allow first enclosure 500 to cover the remaining parts of the packaging assembly 1000 in a telescoping arrangement. In various aspects, the first enclosure 500 can be about the same dimensions as the second enclosure 600. As a result, when the second enclosure 600 telescopes into the first enclosure 500, ends 692, 694, 696, 698 of the sides 602, 604, 606, 608 can contact the inner surface 511 (not visible in the current view). The contact can provide an advantage in preventing air release from interior of the packaging assembly 1000, which can aid in preventing convective heat transfer.

In various aspects, the packaging assembly 1000 can be secured in place using tape, sealant, mechanical edge fastening methods, or can be left without any fastening. In the current aspect, the packaging assembly 1000 is secured in its arrangement by friction such that the packaging assembly 1000 naturally resists separation of the first enclosure 500 from the second enclosure 600. In various aspects, a mechanical connection element such as a latch or other connector can be integrated into the mating design of first enclosure 500 and second enclosure 600 to provide mechanical fastening of these elements.

With returning reference to FIGS. 1-3, it is noted that, in the current aspect, dimensions of the various insulation blocks 100, 200, 300 are coordinating. For example, first dimension 110, third dimension 230, and second dimension 320 can all be properly understood as a thickness of each insulation block 100, 200, 300, respectively. In the current aspect, these thicknesses are the same—although, in various aspects these thicknesses can be different. In additional example, by necessity for the composition of the packaging assembly 1000 of the current aspect, second dimension 120 can be about the same as second dimension 220; similarly, first dimension 210 can be about the same as first dimension 310. In additional example, though, third dimension 130 can be about one-half the length of first dimension 210 and first dimensions 310. Additionally, in the current aspect, second dimension 120 (which is about the same as second dimension 220, as previously noted) can be about twice the length of the thicknesses—which, as previously noticed, is defined by first dimension 110, third dimension 230, and second dimension 320 in the current aspect. The articulated arrangement of dimensions should not be considered limiting on the scope of the disclosure. However, the arrangement of dimensions in the current aspect does provide several advantages, which will be noted elsewhere in this disclosure. One advantage of the presently disclosed aspect is that, because the thickness is large relative to other lengths, the material makeup of the blocks 100, 200, 300 can vary widely in its insulative effect without significantly damaging performance of the packaging solution. Even materials with relatively small R-values for insulative effect can be utilized to insulate. In one aspect, an R-value for the insulative material can be about R-12 at 3 inches.

Figure 8:
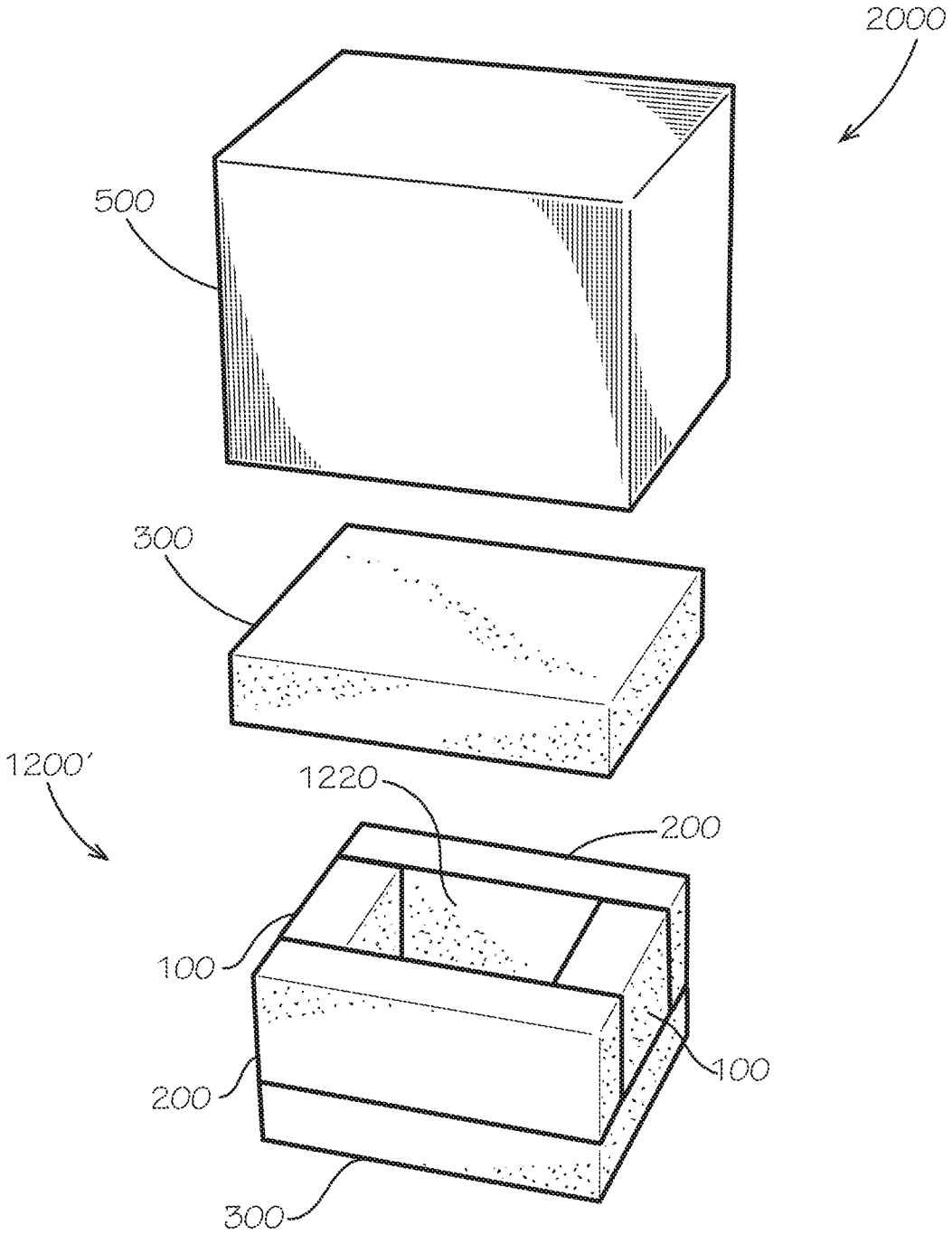
FIG. 8 is an exploded perspective view of a packaging assembly in accord with one aspect of the current disclosure.

Another configuration of the current disclosure is described with reference to FIG. 8. As can be seen, a packaging assembly 2000 can include subassembly 1200' together with third insulation block 300 and first enclosure 500. In the current aspect, subassembly 1200' can be similar in physical arrangement to subassembly 1200 as disclosed with reference to FIG. 7. However, this aspect of packaging assembly 2000 lacks a second enclosure 600 as disclosed with reference to packaging assembly 1000. The packaging assembly 2000 also lacks an inner box 400 in its current aspect, although the various parts that are omitted in one aspect can be interchangeably included in various aspects. Because the packaging assembly 2000 lacks the second enclosure 600, the insulation block 300 that is located at a bottom end of subassembly 1200' forms the bottom of the packaging assembly 2000. It is noted that there is no external mechanical restraint to hold the elements of the packaging assembly 2000 together (as is present in packaging assembly 1000 utilizing second enclosure 600). It is also noted that the omission of inner box 400 would allow the insulation blocks 100 of subassembly 1200' to move inwardly into the void 1220, which could cause collapse of the packaging assembly 2000 onto elements within the packaging. Because of these considerations, it is advantageous that the elements of subassembly 1200' are secured to each other along the joints using adhesive. As a result, packaging assembly 2000 can be easily assembled by securing the first enclosure 500 over the insulation block 300 and subassembly 1200', with insulation block 300 serving as an insulative cover to the void 1220 in subassembly 1200'.

Figure 9:
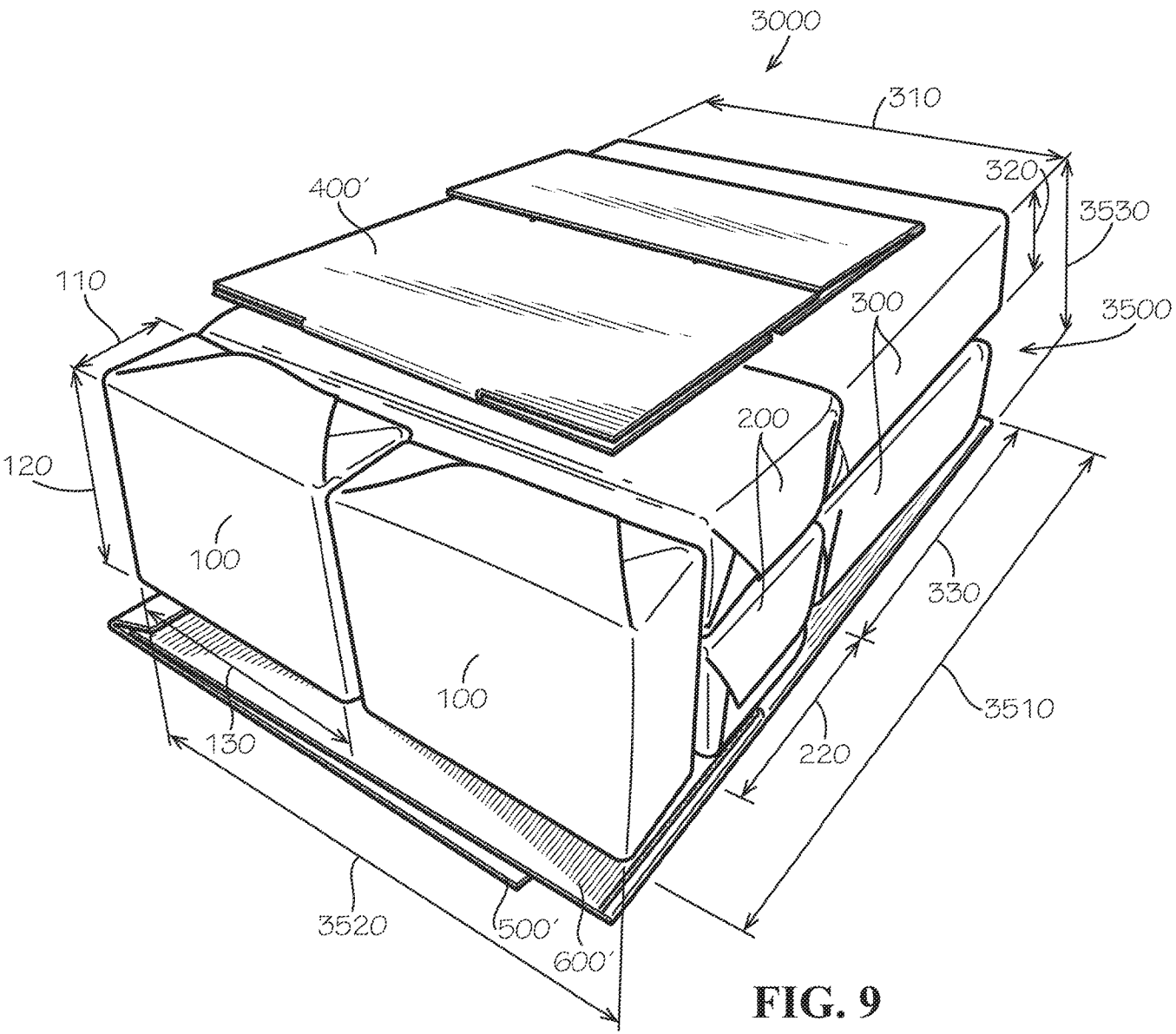
FIG. 9 is a perspective view of a packaging assembly in accord with one aspect of the current disclosure

With reference to FIG. 9, a collapsed packaging assembly 3000 is described in one aspect of the disclosure. The packaging assembly 3000 can include the elements of packaging assembly 1000 in a form as can be provided to a user to assemble into at least one of packaging assembly 1000 and packaging assembly 2000. Packaging assembly 3000 can include two first insulation blocks 100, two second insulation locks 200, and two third insulation blocks 300. As previously disclosed, dimensions of the various elements as presently disclosed can include various advantages, which are discussed herein with reference to FIG. 9. For example, it was previously noted that the third dimension 130 was about equal to one-half of the length of the first dimension 310 and the first dimension 210 (not annotated in the current view). Additionally, the second dimension 120 was previously described to be about twice the length of the thicknesses which were annotated as first dimension 110, third dimension 230, and second dimension 320. As can be seen, these aspects together can provide valuable parameters for the packaging assembly 3000, in that the two first insulation blocks 100 can be arranged end-to-end and fit in a sized relationship next to the other insulation blocks 200, 300. Additionally, because the second dimension 120 can be about double the length of the thicknesses, the additional insulation blocks 200, 300 can be arranged in lay-flat relationship and about match the height of the insulation blocks 100.

As can be seen, inner box 400' is provided and can be the same in physical relationship as inner box 400 except that inner box 400' can be provided as part of packaging assembly 3000 in collapsed arrangement. A user seeking to utilize inner box 400 can form the inner box 400 from inner box 400' by arranging the inner box 400' in an uncollapsed state. Similarly, first enclosure 500' and second enclosure 600' can be arranged as collapsed arrangements of first enclosure 500 and first enclosure 600, respectively.

In the particular arrangement of the various insulation blocks 100, 200, 300 of the packaging assembly 3000, the resulting assembly can be a rectangular subassembly 3500 of rectangular shape that can be easily assembled by the manufacturer, easily stacked, easily supplied to the user, and easily assembled into a packaging assembly such as packaging assembly 1000 or packaging assembly 2000. It is noted that the sizing of the collapsed enclosures 500', 600' is about equal to the sizing of the rectangular subassembly 3500. Although the rectangular subassembly 3500 can include a plurality of parts assembled together, in various aspects varying numbers of parts can be utilized, including more parts than shown or fewer parts than shown. In various aspects, the rectangular subassembly 3500 can be formed of a single part.

As seen, the rectangular subassembly 3500 can include a first dimension 3510, a second dimension 3520, and a third dimension 3530. In the current aspect, the first dimension 3510 can be about the same as the combination of first dimension 110, second dimension 220, and third dimension 330. Additionally, the second dimension 3520 can be about the same as first dimension 210 (not annotated in the current view), first dimension 310, and double third dimension 130. As a result, the collapsed enclosures 500',600', being of about the same rectangular dimensions as the rectangular subassembly 3500, can provide a bottom surface of the packaging assembly 3000 that allows the rectangular subassembly 3500 to be easily supported. As seen with reference to FIG. 9, inner box 400' can be provided in collapsed form on top of the rectangular subassembly 3500 such that the packaging assembly 3000 is of minimal spatial sizing.

In various aspects, the packaging assembly 3000 can be supplied in various forms. For example, the packaging assembly 3000 in various aspects can be cellophane-wrapped to allow the assembly to be received by the user in assembly form, ready to be shipped. In various aspects, the packaging assembly 3000 can be supplied inside a corrugated cardboard box. In various aspects, the packaging assembly 3000 can be supplied restrained by packaging tape, strapping tape, on non-adhesive strapping, such as metal strapping, vinyl strapping, or other compositions of restraint. In one aspect, adhesive can be starch-based PVA. Additional mechanical restraints can be utilized in various aspects. In various aspects, the packaging assembly 3000 can be utilized from stock, such that mechanical restraint (such as cellophane, cardboard, or various other restraints) is unnecessary. In various aspects, multiple packaging assemblies 3000 can be supplied to the user within one assembly, such that a single restraint system can enclose or restrain multiple implementations of the packaging assembly 3000.

To form packaging assembly 1000 from packaging assembly 3000, a user can receive the packaging assembly 3000; form the inner box 400 from the inner box 400'; form the first enclosure 500 from first enclosure 500'; form second enclosure 600 from second enclosure 600'; insert third insulation block 300 with its ends arranged to match the profile of second enclosure 600; arrange the first insulation blocks 100 and second insulation blocks 200 on the third insulation block 300 within the second enclosure 600; and insert the inner box 400 inside the void 1220 defined by the subassembly 1200. Following the above-described procedure, the packaging assembly 1000 is ready to receive an element to be shipped. Once the element to be shipped is arranged within the inner box 400, the user can complete the packaging assembly 1000 by arranging the third insulation block 300 on top of the subassembly 1200 within the second enclosure 600; and enclosing the packaging assembly 1000 by arranging the first enclosure 500 over the second enclosure 600. The user can optionally fasten the first enclosure 500 to the second enclosure 600. Adhesives or mechanical fasteners can optionally be used to join or to seal the various elements of the packaging assembly 1000.

To form packaging assembly 2000 from packaging assembly 3000, a user can receive packaging assembly 3000; arrange the first insulation blocks 100 and second insulation blocks 200 on surface 332 of the third insulation block 300, fastening the first insulation blocks 100 and second insulation blocks 200 to each other and to the third insulation block 300. In the current aspect of packaging assembly 2000, adhesive can be used along the joints of the various insulation blocks 100, 200, 300. Other mechanical fastening, sealing, connection, or attachment methods and means are contemplated to be within the scope of the present disclosure. When the insulation blocks 100, 200, 300 are arranged and fastened to form subassembly 1200', the packaging assembly 2000 is ready to receive an element to be shipped. Once the element to be shipped is arranged within the subassembly 1200', the third insulation block 300 can be attached, sealed, or fastened to the subassembly 1200'. The third insulation block 300 need not be mechanically joined to the subassembly 1200' because it is intended to be enclosed by first enclosure 500. However, in various aspects, the attachment of third insulation block 300 to the subassembly 1200' can provide some strategic advantages in sealing and connecting the elements of packaging assembly 2000. When first enclosure 500 is arranged over the combination of third insulation block 300 and subassembly 1200', the packaging assembly 2000 is completed. The user can optionally connect the first enclosure 500 to the subassembly 1200' with various fastening or attachment methods or apparatus, such as tape, glue, sealant, staples, or other connection apparatus.

It can be helpful to provide some temperature-regulating material in various aspects. In some aspects, dry ice can be utilized to help reduce internal temperature of the packaging assembly 1000, 3000. Additionally, in various aspects, phase-change materials can be utilized to regulate specific temperature ranges. In environments where temperature is required to be maintained at a heightened level, heating elements can be utilized to keep temperature at a higher level.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions should be understood as representing modules, segments, or portions, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A packaging assembly comprising:

a pair of first insulation blocks, each first insulation block being rectangular in shape and containing loose fill insulation and having six surfaces including a first pair of opposing surfaces, a second pair of opposing surfaces, and a third pair of opposing surfaces, each first insulation block of a first dimension as measured between the third pair of opposing surfaces, each first insulation block of a second dimension as measured between the first pair of opposing surfaces, and each first insulation block of a third dimension as measured between the second pair of opposing surfaces, the first dimension of each first insulation block being a thickness;

a pair of second insulation blocks, each second insulation block being rectangular in shape and containing loose fill insulation and having six surfaces including a first pair of opposing surfaces, a second pair of opposing surfaces, and a third pair of opposing surfaces, each second insulation block of a first dimension as measured between the second pair of opposing surfaces, each second insulation block of a second dimension as measured between the first pair of opposing surfaces, and each second insulation block of a third dimension as measured between the third pair of opposing surfaces, the third dimension of each second insulation block being a thickness that is about the same as the thickness of each first insulation block;

a pair of third insulation blocks, each third insulation block being rectangular in shape and containing loose fill insulation and having six surfaces including a first pair of opposing surfaces, a second pair of opposing surfaces, and a third pair of opposing surfaces, each third insulation block of a first dimension as measured between the second pair of opposing surfaces, each third insulation block of a second dimension as measured between the third pair of opposing surfaces, and each third insulation block of a third dimension as measured between the first pair of opposing surfaces, the second dimension of each third insulation block being a thickness that is about the same as the thickness of each first insulation block and each second insulation block;

a first enclosure, the first enclosure including a first side, a second side, a third side, a fourth side, and a top side, the first side connected to the third side and the fourth side, the first side opposing the second side, the second side also connected to the second side and the fourth side, and at least one of the first side, second side, third side, and fourth side connected to the top side;

wherein the first enclosure is arranged in a collapsed form, wherein each first insulation block, second insulation block, and third insulation block are arranged on top of and abutting the collapsed first enclosure, wherein the pair of first insulation blocks, the pair of second insulation blocks, and the pair of third insulation blocks are arranged in abutting relationship to form a rectangular subassembly, the rectangular subassembly having a first dimension that is about the same as a combination of the first dimension of the first insulation block with the second dimension of the second insulation block and the third dimension of the third insulation block, wherein the rectangular subassembly has a second dimension that is about the same as the first dimension of the second insulation block, which is about the same as the first dimension of the third insulation block, and which is about twice the third dimension of the first insulation block, wherein the rectangular subassembly has a third dimension that is about the same as the second dimension of the first insulation block, which is also about twice the second dimension of the third insulation block; and wherein the first dimension and second dimension of the rectangular subassembly are of about the same dimensions as the rectangular space of the collapsed first enclosure.

2. The packaging assembly of claim 1, further comprising a second enclosure, the second enclosure including a first side, a second side, a third side, a fourth side, and a bottom side, the first side of the second enclosure connected to the third side of the second enclosure and the fourth side of the second enclosure, the first side of the second enclosure opposing the second side of the second enclosure, the second side of the second enclosure also connected to the second side of the second enclosure and the fourth side of the second enclosure, and at least one of the first side, second side, third side, and fourth side of the second enclosure connected to the bottom side of the second enclosure, wherein the second enclosure is arranged in collapsed form, and wherein the collapsed second enclosure is arranged contacting the collapsed first enclosure.

3. The packaging assembly of claim 2, further comprising an inner box, the inner box including a first side, a second side, a third side, a fourth side, and a bottom side, the first side of the inner box connected to the third side of the inner box and the fourth side of the inner box, the first side of the inner box opposing the second side of the inner box, the second side of the inner box also connected to the second side of the inner box and the fourth side of the inner box, and at least one of the first side, second side, third side, and fourth side of the inner box connected to the bottom side of the inner box, wherein the inner box is arranged in collapsed form, and wherein the collapsed inner box is arranged contacting at least one of the insulation blocks.

4. A packaging assembly comprising:

a pair of first insulation blocks, each first insulation block being rectangular in shape and containing insulation and having six surfaces including a first pair of opposing surfaces, a second pair of opposing surfaces, and a third pair of opposing surfaces, each first insulation block of a first dimension as measured between the third pair of opposing surfaces, each first insulation block of a second dimension as measured between the first pair of opposing surfaces, and each first insulation block of a third dimension as measured between the second pair of opposing surfaces, the first dimension of each first insulation block being a thickness;

a pair of second insulation blocks, each second insulation block being rectangular in shape and containing loose fill insulation and having six surfaces including a first pair of opposing surfaces, a second pair of opposing surfaces, and a third pair of opposing surfaces, each second insulation block of a first dimension as measured between the second pair of opposing surfaces, each second insulation block of a second dimension as measured between the first pair of opposing surfaces, and each second insulation block of a third dimension as measured between the third pair of opposing surfaces, the third dimension of each second insulation block being a thickness that is about the same as the thickness of each first insulation block;

a pair of third insulation blocks, each third insulation block being rectangular in shape and containing loose fill insulation and having six surfaces including a first pair of opposing surfaces, a second pair of opposing surfaces, and a third pair of opposing surfaces, each third insulation block of a first dimension as measured between the second pair of opposing surfaces, each third insulation block of a second dimension as measured between the third pair of opposing surfaces, and each third insulation block of a third dimension as measured between the first pair of opposing surfaces, the second dimension of each third insulation block being a thickness that is about the same as the thickness of each first insulation block and each second insulation block;

a first enclosure, the first enclosure including a first side, a second side, a third side, a fourth side, and a top side, the first side connected to the third side and the fourth side, the first side opposing the second side, the second side also connected to the second side and the fourth side, and at least one of the first side, second side, third side, and fourth side connected to the top side;

wherein the first enclosure is arranged in a collapsed form; and wherein a rectangular subassembly is arranged on top of and abutting the collapsed first enclosure, the rectangular subassembly being arranged from the insulation blocks, wherein one third insulation block is arranged on top of another third insulation block such that one third surface of one third insulation block is contacting one third surface of the other third insulation block;

wherein one second insulation block is arranged on top of another second insulation block such that one third surface of one second insulation block contacts one third surface of the other second insulation block, each first surface of each second insulation block contacting one first surface of each third insulation block;

wherein one first insulation block is arranged next to another first insulation block such that one second surface of one first insulation block contacts one second surface another first insulation block, each third surface of each first insulation block contacting both second insulation blocks.

5. The packaging assembly of claim 4, wherein the rectangular subassembly defines a first dimension, a second dimension, and a third dimension, wherein the third dimension of the rectangular subassembly is about the same as twice the second dimensions of the third insulation block, wherein the second dimensions of the rectangular subassembly is about the same as the first dimensions of the third insulation block, and wherein the first dimension of the rectangular subassembly is about the same as a combination of the first dimension of the first insulation block plus the second dimension of the second insulation block plus the third dimension of the third insulation block.

6. The packaging assembly of claim 5, wherein the first dimension of each second insulation block is about the same as the first dimension of each third insulation block and is about the same as twice the third dimension of the first insulation block, wherein the blocks are lined up such that the dimensions are coordinate where possible so that no one insulation block extends beyond the rectangular subassembly.

7. The packaging assembly of claim 5, wherein the first dimension and second dimension of the rectangular subassembly are about the same as the rectangular dimensions of the collapsed first enclosure such that the rectangular subassembly is arranged on top of the collapsed first enclosure without substantial overlap.

8. The packaging assembly of claim 7, wherein a second enclosure in collapsed form is arranged on top of and abutting the rectangular subassembly without overlapping the dimensions of the rectangular subassembly.

* * * * *